US006971942B2

(12) United States Patent
Baker et al.

(10) Patent No.: US 6,971,942 B2
(45) Date of Patent: Dec. 6, 2005

(54) ROTARY FEEDBACK MECHANISM FOR A TOY

(75) Inventors: Ernest D. Baker, Ellicott City, MD (US); Leonard R. Clark, Jr., Oreland, PA (US); Jesse Dorogusker, San Francisco, CA (US); David Vincent Helmlinger, Mt. Laurel, NJ (US); Eric David Listenberger, Moorestown, NJ (US); Joseph Thomas Moll, Prospect Park, PA (US); David Ribbe, Marlton, NJ (US); Stephen N. Weiss, Philadelphia, PA (US)

(73) Assignee: Mattel, Inc., El Segundo, CA (US)

( * ) Notice: Subject to any disclaimer, the term of this patent is extended or adjusted under 35 U.S.C. 154(b) by 100 days.

(21) Appl. No.: 10/757,154

(22) Filed: Jan. 14, 2004

(65) Prior Publication Data

US 2004/0144582 A1 Jul. 29, 2004

Related U.S. Application Data

(62) Division of application No. 10/071,519, filed on Feb. 8, 2002, now Pat. No. 6,726,523.

(60) Provisional application No. 60/267,871, filed on Feb. 9, 2001.

(51) Int. Cl.[7] ..... A63H 11/00

(52) U.S. Cl. ..... 446/275; 446/276; 446/279; 446/288; 180/181

(58) Field of Search ..... 180/181, 180; 446/276, 275, 279, 288, 456, 462, 273, 313, 446/431, 457, 460

(56) References Cited

U.S. PATENT DOCUMENTS

| | | | | |
|---|---|---|---|---|
| 1,686,061 | A | 10/1928 | Allinger | |
| 3,946,691 | A | 3/1976 | Freeman | |
| 4,290,228 | A | 9/1981 | Goldfarb et al. | |
| 4,705,487 | A | 11/1987 | Ishimoto | |
| 4,817,948 | A | 4/1989 | Simonelli | |
| 4,836,819 | A * | 6/1989 | Oishi et al. | 446/288 |
| 5,020,621 | A | 6/1991 | Martin | |
| 5,107,424 | A * | 4/1992 | Bird et al. | 701/21 |
| 5,330,026 | A | 7/1994 | Hsu et al. | |
| 5,368,516 | A | 11/1994 | Hoeting et al. | |
| 5,762,554 | A * | 6/1998 | Siu | 463/37 |
| 5,893,425 | A | 4/1999 | Finkle | |
| 5,947,788 | A | 9/1999 | Derrah | |
| 6,050,357 | A | 4/2000 | Staelin et al. | |
| 6,074,271 | A * | 6/2000 | Derrah | 446/457 |
| 6,315,630 | B1 * | 11/2001 | Yamasaki | 446/275 |
| 6,467,560 | B1 | 10/2002 | Anderson | |
| 6,726,523 | B2 * | 4/2004 | Baker et al. | 446/225 |

FOREIGN PATENT DOCUMENTS

| | | |
|---|---|---|
| GB | 2186501 A1 | 8/1987 |
| TW | 215169 | 10/1993 |

* cited by examiner

*Primary Examiner*—J. Allen Shriver
(74) *Attorney, Agent, or Firm*—Akin Gump Strauss Hauer & Feld, LLP

(57) ABSTRACT

A rotary feedback mechanism includes a first set of electrically conductive pads mounted to a first member and a wiper mounted to a second member. As the first and second members rotate relative to one another, the wiper sequentially contacts one or more pads of the first set of pads and provides an electrical signal to the contacted pad or pads. The electrical signal is communicated via the pad or pads to a controller, providing the controller with an indication of the angular position of the first member relative to the second member.

3 Claims, 26 Drawing Sheets

ROTARY FEEDBACK MECHANISM FOR A TOY

CROSS-REFERENCE TO RELATED APPLICATIONS

This application is a division of prior U.S. patent application Ser. No. 10/071,519, filed Feb. 8, 2002, now U.S. Pat. No. 6,726,523, entitled REMOTE-CONTROLLED SKATEBOARD DEVICE, which claimed priority from U.S. Provisional Patent Application 60/267,871 filed on Feb. 9, 2001.

BACKGROUND OF THE INVENTION

This invention generally relates to electronic position transducers, and more particularly to electronic angular position transducers with rotary feedback mechanisms for use in toys. It is believed that a novel rotary feedback mechanism would be desirable.

SUMMARY OF THE INVENTION

In accordance with a preferred embodiment, the invention is rotary feedback mechanism for a toy. The toy includes a first member and a second member adjoining the first member, the first and second members being rotatable relative to one another about an axis extending through the first and second members. The toy further includes a controller at least monitoring relative angular position of the first and second rotary members with respect to one another. The angular position transducer comprises a first set of at least three separate electrically conductive pads non-rotatably mounted to the first member around the axis at least proximal to the second member. A wiper is non-rotatably mounted to the second member abutting the first set of conductive pads so as to sequentially contact at least some of the first plurality of conductive pads with rotation of the first and second members with respect to one another. A signal commonly provided by the wiper to each of the at least three conductive pads in sequence with rotation of the first and second members with respect to one another. An individual signal conductor from each of the at least three conductive pads of the first plurality to the controller to provide the controller with one or more of a plurality of the commonly provided signals from each of the separate conductive pads contacted by the wiper, the controller associating each signal of the plurality of signals with an individual electric pad to identify each particular pad being contacted by the wiper at any given time such that relative angular position of the first and second members with respect to one another is determined by the controller from the commonly provided signals fed back to the controller by each particular conductive pad of the plurality.

BRIEF DESCRIPTION OF THE SEVERAL VIEWS OF THE DRAWINGS

For the purpose of illustrating the invention, there is shown in the drawings embodiments which are presently preferred. It should be understood, however, that the invention is not limited to the precise arrangements and instrumentalities shown.

In the drawings:

FIG. 37 is a side elevation of an alternate steering arrangement.

DETAILED DESCRIPTION OF THE INVENTION

Figure 1:
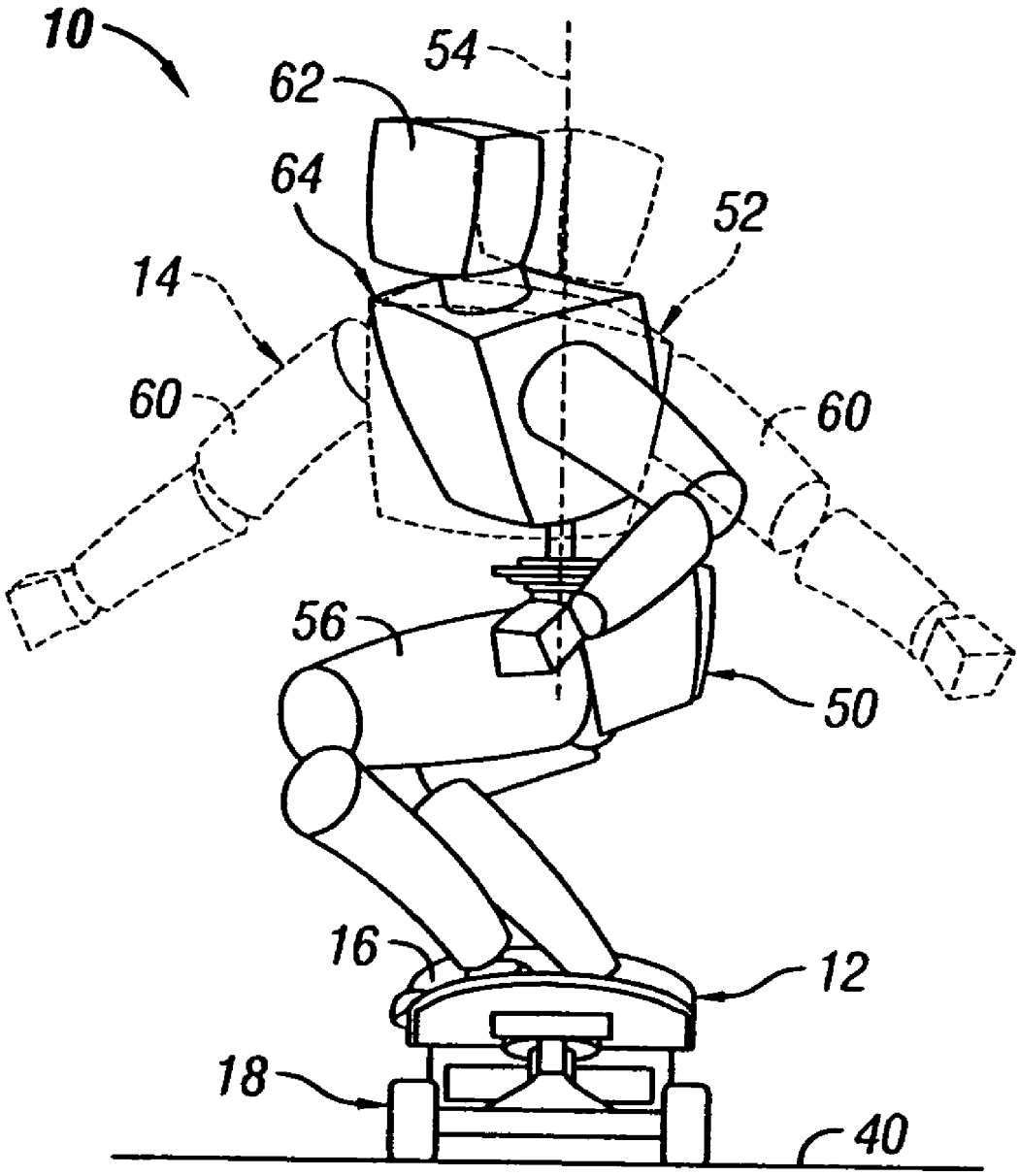
FIG. 1 schematically illustrates, in front elevational view, a radio controlled toy skateboard device with a toy figure mounted on a toy skateboard and shown rotated at different positions with respect to the skateboard.
Figure 2:
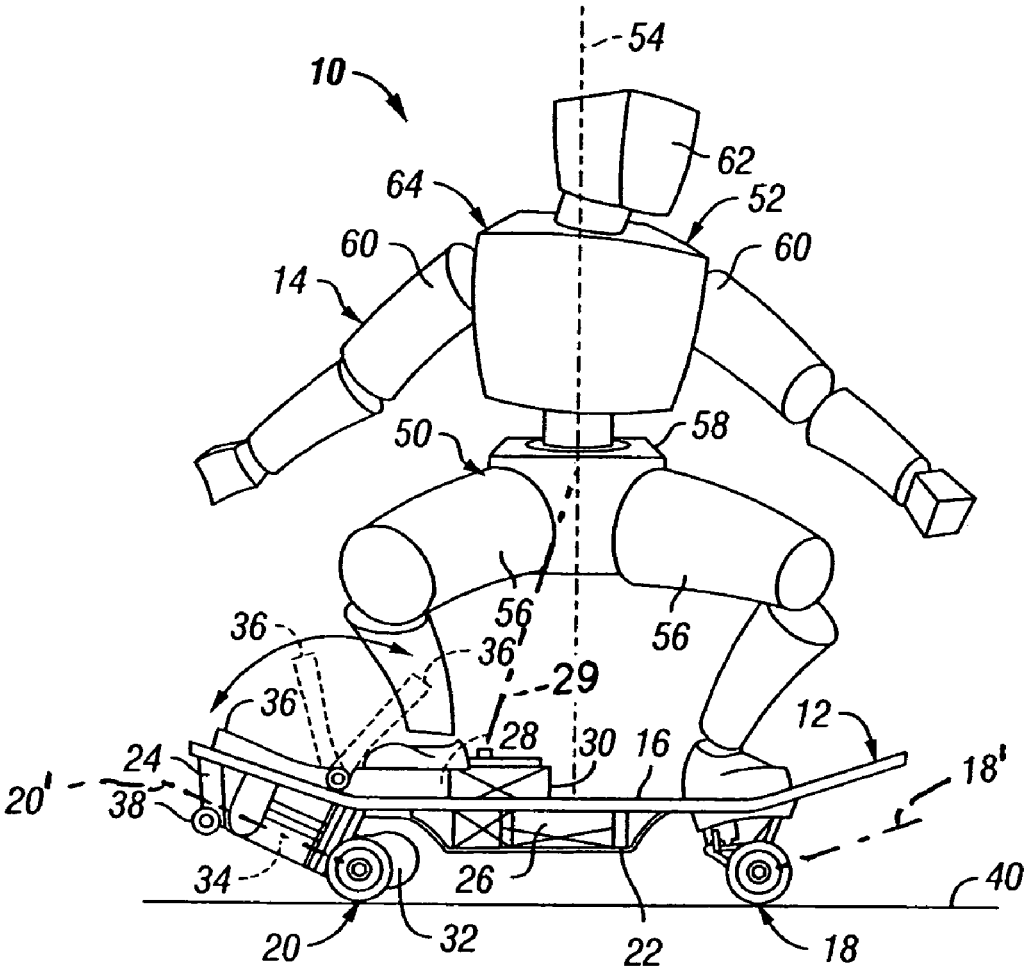
FIG. 2 is a side elevational view of the toy skateboard device of FIG. 1.
Figure 3:
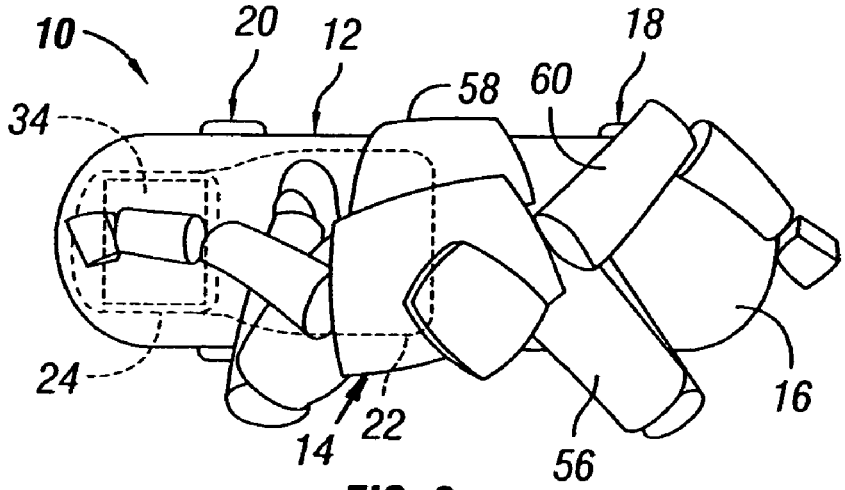
FIG. 3 is a top plan view of the toy skateboard device of FIG. 1.
Figure 14:
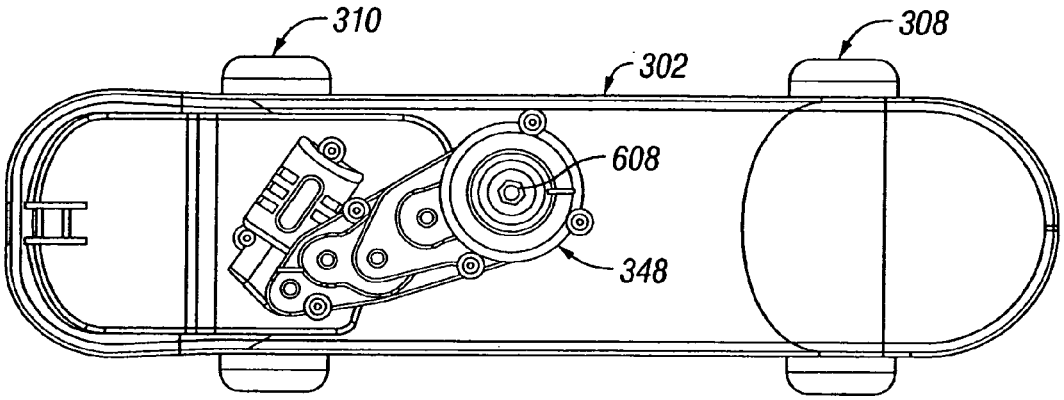
FIG. 14 is a top plan view of the skateboard device third embodiment.
Figure 15:
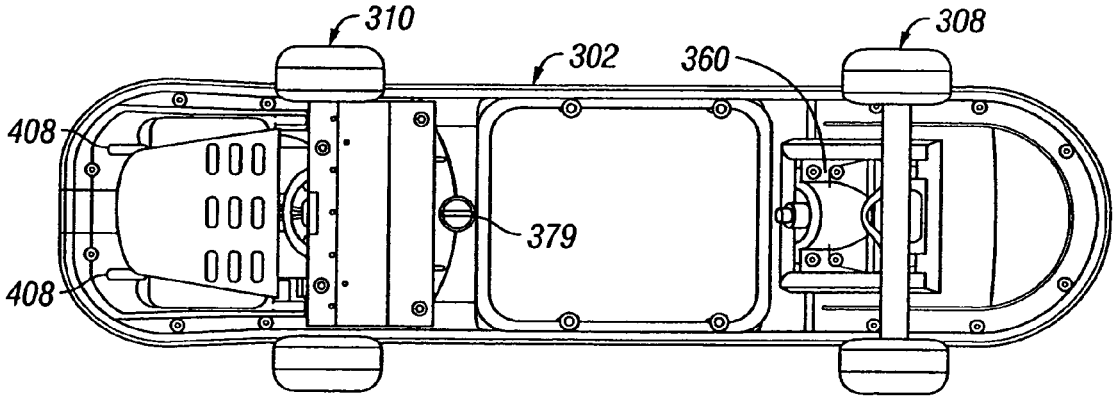
FIG. 15 is a bottom plan view of the skateboard device third embodiment.
Figure 16:
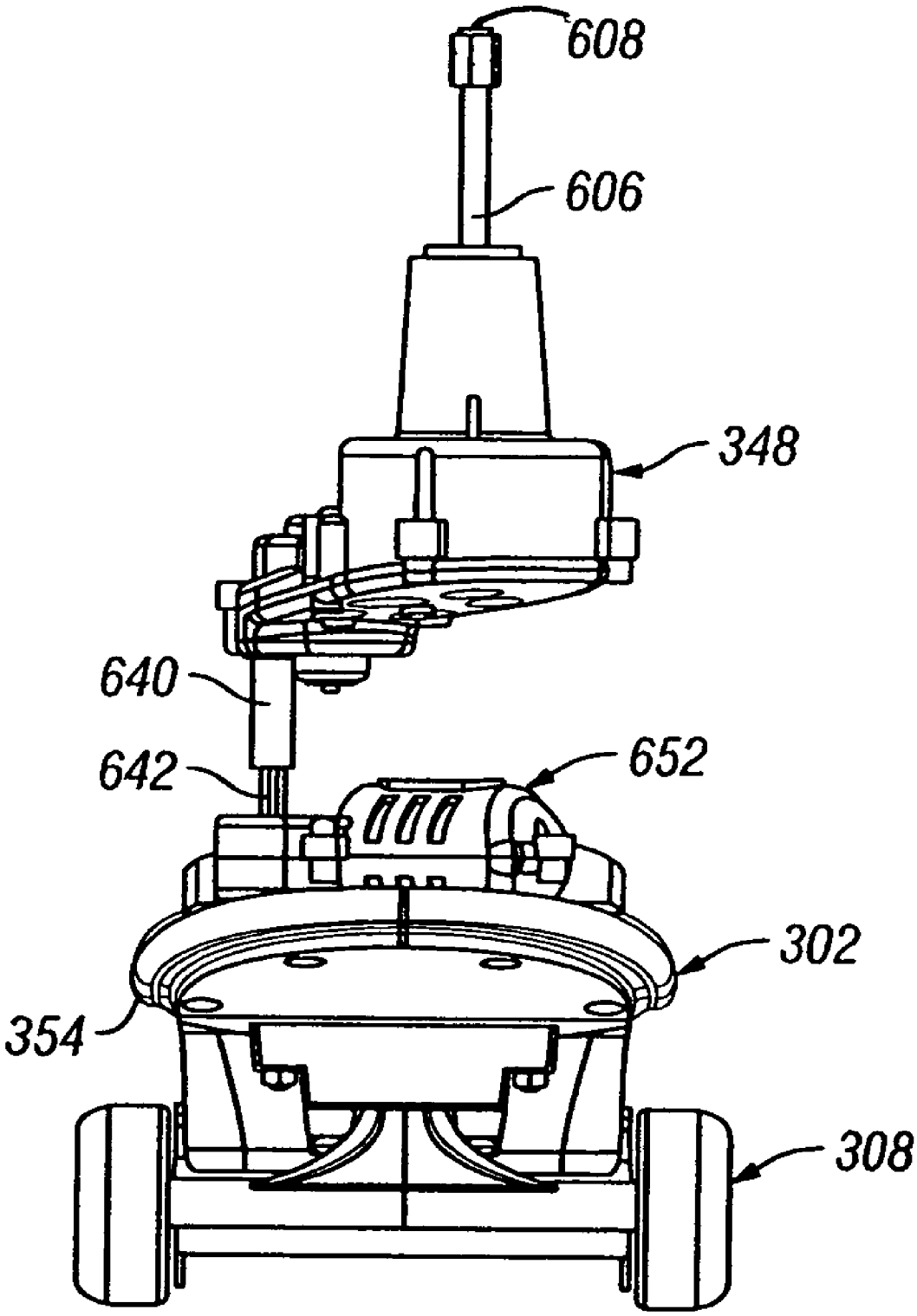
FIG. 16 is a front plan view of the skateboard device third embodiment.
Figure 17:
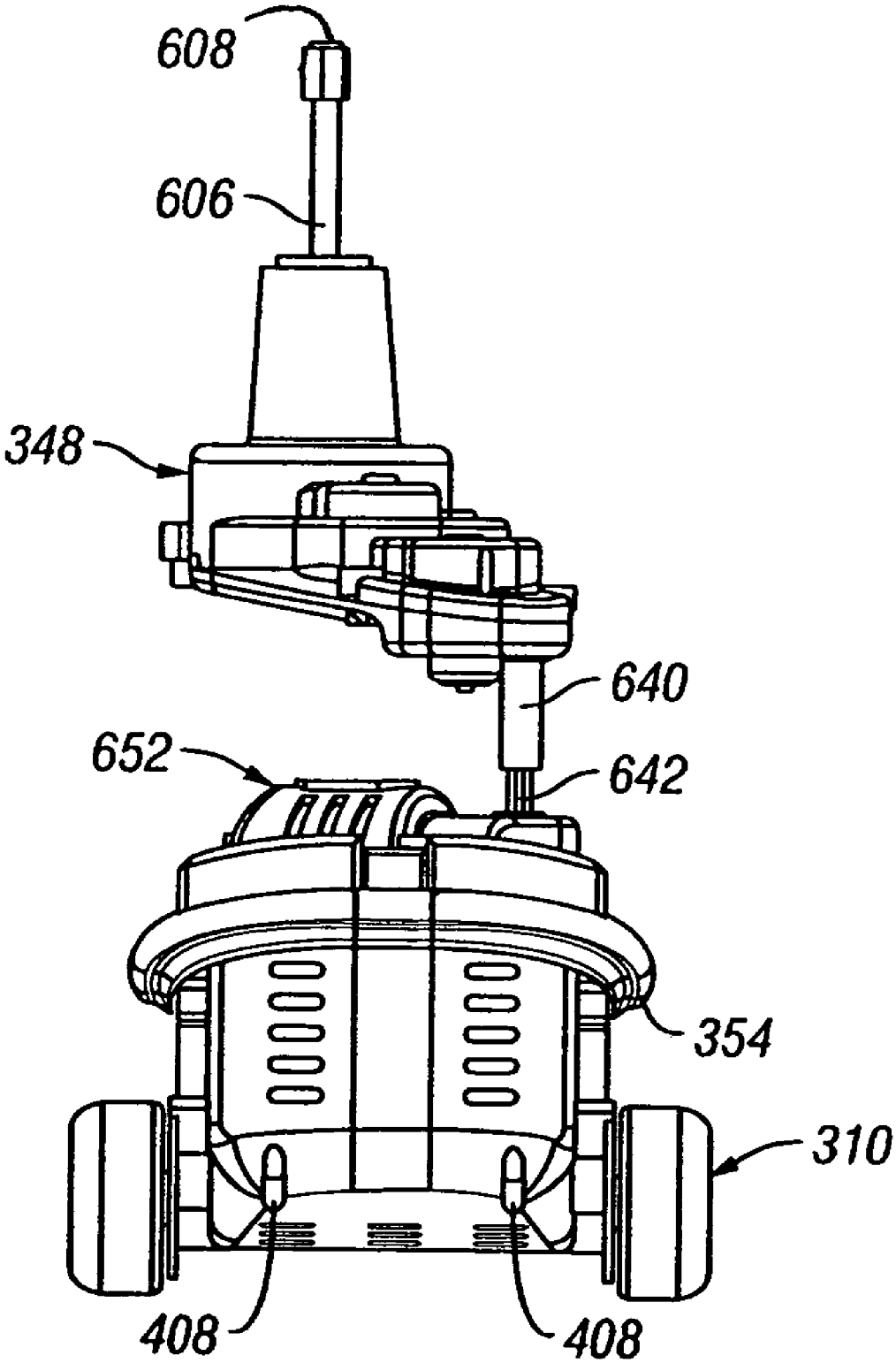
FIG. 17 is a rear plan view of the skateboard device fourth embodiment.

Referring now to the drawings, and to FIGS. 1 to 3 in particular, remotely controlled toy skateboard device 10 according to a first embodiment of the invention is illustrated. As shown, the toy skateboard device 10 includes a skateboard 12 and a toy figure 14 mounted on the skateboard.

The skateboard 12 includes a platform or deck 16 with a front truck assembly 18 and a rear truck assembly 20 connected to an underside of the platform. Each assembly 18, 20 includes a pair of spaced wheels. A first compartment 22 is formed in the platform 16 between the front and rear truck assemblies and a second compartment 24 is formed in the platform behind the rear truck assembly 20. The first compartment 22 houses an on-board control unit including integrated radio receiver and controller circuitry 26 to control all on-board motors, servos and other electrically operated actuators. A first drive unit in the form of a steering mechanism 28 including an electrically operated actuator (not depicted) and another drive unit in the form of a torso drive unit 30 are located on the platform 16 above the first compartment 22. The second compartment 24 houses a drive motor 32 for each drive wheel of the rear truck assembly 20 and a battery 34 for powering the integrated receiver and controller, the torso drive unit 30, steering mechanism 18 and the motors 32. A battery access door 36 is hingedly connected to the platform 24 adjacent the second compartment 24 for normally closing the second compartment. A pair of rollers 38 are rotatably mounted to a lower rear end of the second compartment 24. The rollers 38 are normally spaced from the ground 40 or other support surface when the front and rear truck assemblies 18, 20 are in contact with the support surface, and can contact the support surface 40 when the front truck assembly 18 leaves the support surface 40 during a "wheelie" maneuver. The toy figure 14 includes a lower body portion 50 and an upper body portion 52 rotatably connected to the lower body portion about an axis 54.

The lower body portion 50 includes a pair of legs 56 connected to a hip portion 58. Preferably, the legs 56 are formed in a permanently bent position to simulate the natural stance of a person on a skateboard, but may alternatively flex to a degree about the knees and/or hip portion 58. In a further embodiment, the toy figure 14 may be configured to be responsive to commands from a radio control signal or the like to change the position of the legs 56 and/or hip portion 58.

The upper body portion 50 includes a pair of arms 60 and a head 62 connected to a torso portion 64. Preferably, the arms 60 and head 62 are fixed with respect to the torso portion 64 to simulate the natural stance of a person on a skateboard, but may alternatively flex about the elbows and/or neck. The upper body portion 52 is operably coupled to the torso drive unit 30 by connection 29 (in phantom) to pivot about the axis 54 in response to a received radio control signal. The actual amount of twisting movement can be monitored and controlled through a servo feedback unit, which will be described in greater detail below with respect to further embodiments of the invention.

The speed and direction of travel of the toy skateboard device 10 is controlled by a portable remote control unit (e.g. FIGS. 35–36) through wireless transmitted control signals with the on-board control unit by causing the platform 16 to pivot with respect to at least one of the assemblies 18, 20 in a way to cause the truck assemblies to turn slightly on the ground under the platform, thereby causing the device 10 to turn. The platform 16 is pivoted on at least the rear truck assembly 18 which is mounted to pivot about an axis 18' (FIG. 2) extending at an angle between horizontal and vertical. Preferably, the direction of travel is also monitored and controlled through a servo feedback unit, as will also be described in greater detail below. Although the use of radio waves is the preferred medium for transmitting the control signals, other wireless means for transmitting control signals to the toy skateboard device 10 can be used, such as infrared, ultrasonic, visible light, and so on. Alternatively, the portable control unit may be directly wired to the toy skateboard device 10.

Figure 4:
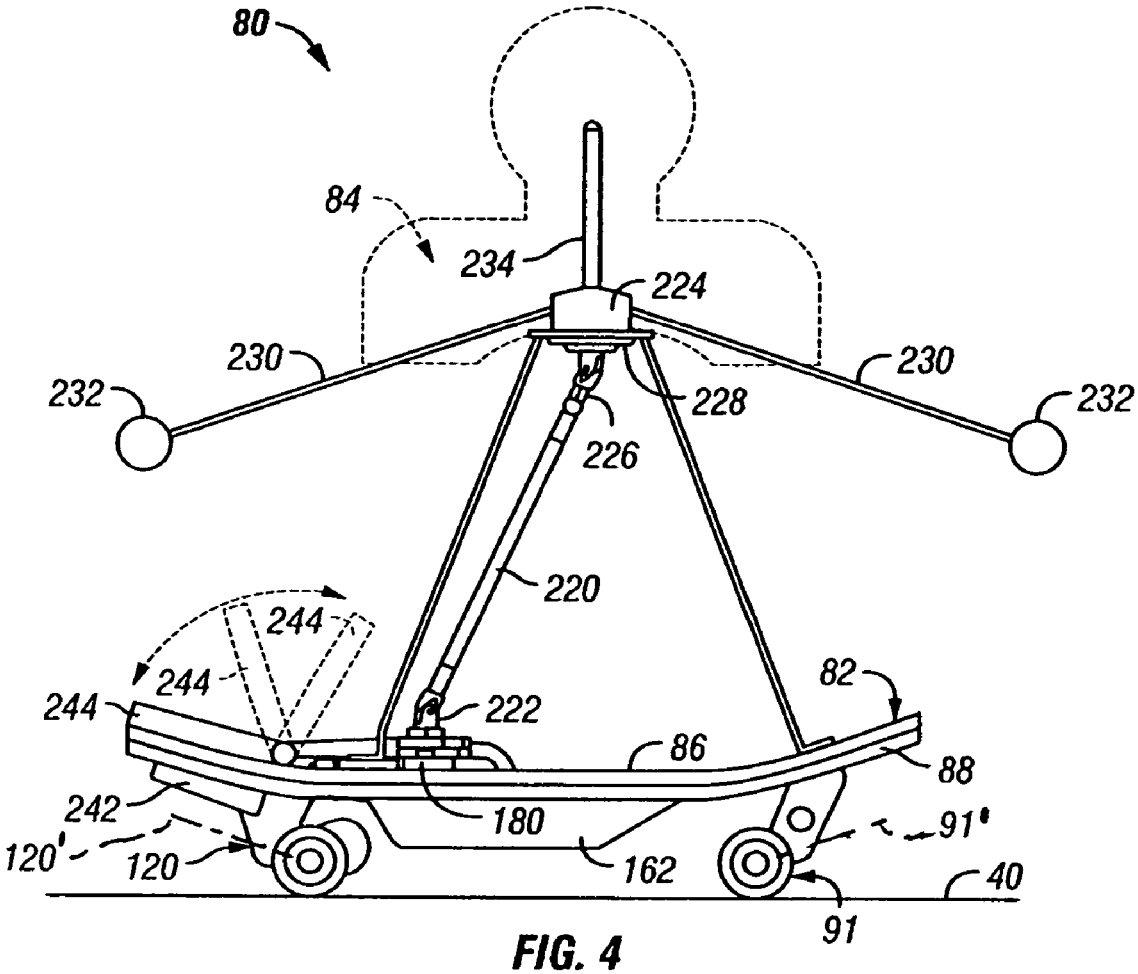
FIG. 4 is a side elevational view of a toy skateboard device according to a second embodiment of the present invention.
Figure 5:
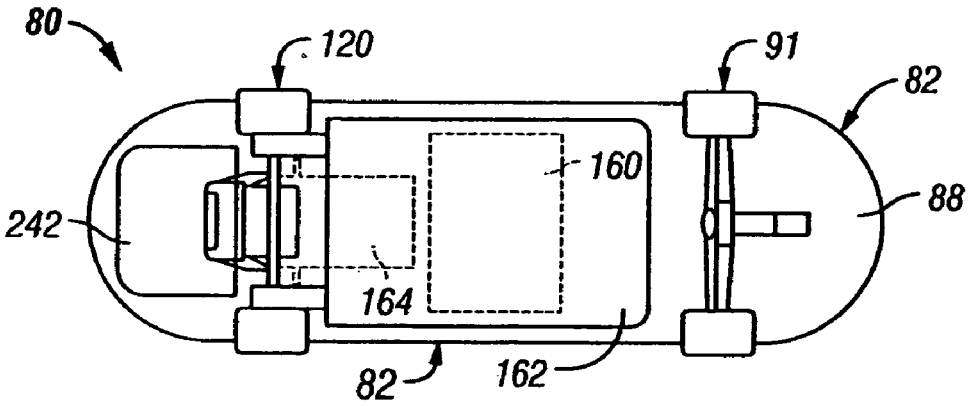
FIG. 5 is a bottom plan view of the toy skateboard device of FIG. 4.
Figure 6:
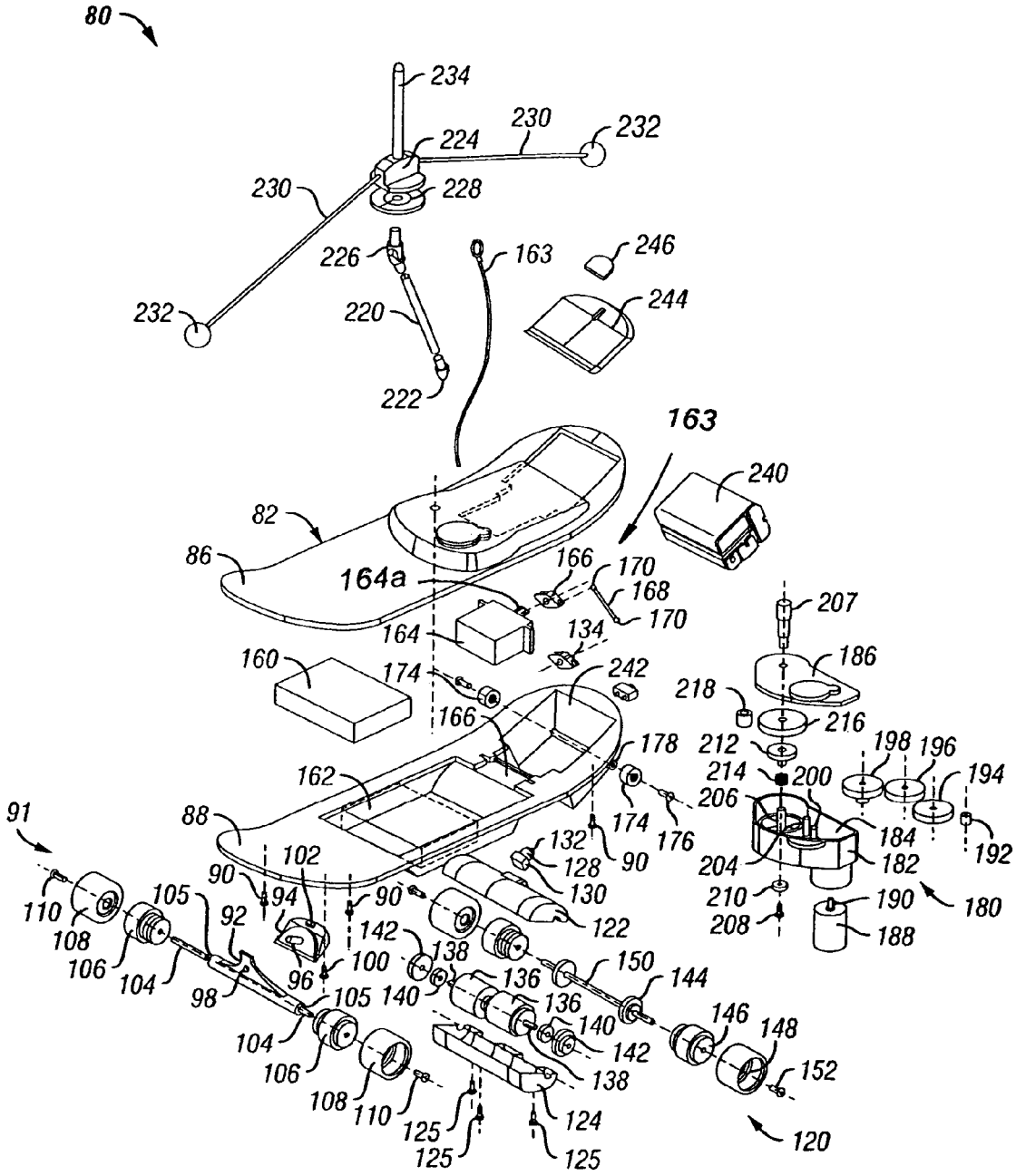
FIG. 6 is an exploded isometric view of the toy skateboard device of FIG. 4.

With reference now to FIGS. 4 to 6, a toy skateboard device 80 according to a further embodiment of the invention is illustrated. The skateboard device 80 includes a skateboard 82 and a toy figure 84 mounted to the skateboard.

As shown most clearly in FIG. 6, the skateboard 82 includes an elongated skateboard deck 85 with a board upper housing 86 and a board lower housing 88. The upper and lower housings are preferably constructed of injection-molded ABS, or other suitable material, and are secured together through fasteners 90. Alternatively, the housings may be secured together through adhesive bonding, ultrasonic welding, or other well-known fastening technique.

A front truck assembly 91 includes a front truck front portion 92 that is pivotally attached to a front truck rear portion 94 through a pivot pin 96 on the rear portion 94 that extends into a bore 98 formed in the front portion 92. The front truck rear portion 94 includes a generally vertically extending bore 102 through which a fastener 100 extends for mounting the rear portion 94 to the lower housing 88. The front truck front and rear portions 92, 94 are also preferably injection-molded of ABS or other suitable material. A wheel axle 104, preferably a shaft constructed of steel, extends transversely to the deck from opposite lateral sides 105 of the front truck front portion 92. Spaced front wheel hubs 106, preferably constructed of injection molded ABS material, are rotatably mounted on each end of axle 104. A tire 108, preferably constructed of an elastomer, is mounted on each hub 106. A fastener 110 extends through each wheel and hub combination and threads into an outer free end of the axle 104 for holding the assembly together.

A rear truck assembly 120 includes a rear truck upper housing portion 122 connected to a rear truck lower housing portion 124 through fasteners 125 or other suitable connecting means. The rear truck upper and lower housing portions are preferably injection-molded of ABS or other suitable material. A rear pivot boss 128, preferably formed of injection-molded Delrin, includes a square-shaped head portion 130 that is mounted in the rear upper housing portion 122 and a cylindrical pivot portion 132 that is secured in or with a bracket 134 for rotation therewith. A pair of electric motors 136 are arranged in opposing relationship transverse to the deck in the rear upper and lower housing portions 122 and 124, respectively. Each motor 136 has a shaft 138 that extends laterally therefrom. A pinion gear 140, preferably constructed of brass, and a combo gear 142, preferably constructed of brass and nylon, are mounted on each shaft 138 in opposite orientations. A combo gear 144, a rear wheel gear hub 146, and a rear wheel tire 148 are connected to opposite ends of a rear shaft 150 through a fastener 152 that threads or clips into the shaft. Shaft 150 also extends transversely to the elongated deck. Preferably, the combo gears 144 are constructed of nylon and brass, the rear wheel gear hubs 146 are constructed of nylon, the rear tires are constructed of molded elastomer, and the rear shaft 150 is constructed of steel.

An on-board control unit 160 with integrated radio receiver and controller are located in a compartment 162 of the board lower housing 88. On-board control unit 160 permits the receipt and processing of wireless transmitted control signals from a portable remote control unit (see FIGS. 35–36) to control steering and propulsion of the device 80 and movement of torso of a figure 84 (in phantom). An antenna 163 extends through the board upper housing 86 and is connected to the on-board control unit 160. A first drive unit in the form of a steering mechanism 163 includes an electronically operated actuator 164, bracket 166 and link arm 168. Actuator 164 is mounted in a depression 166 formed in the board lower housing 88 and is operably connected to the on-board control unit 160 to control the tilt and thus the steering angle between the rear truck assembly 120 and the deck. Bracket 166 is similar to bracket 134 and is secured to a shaft 164*a* of the actuator 164. Steering link arm 168 has ball-shaped ends 170 that fit within sockets formed in the brackets 134, 166. In response to rotation of the rotary output shaft 164*a*, the platform or deck 85 will tilt generally longitudinally at least about the central axis of pivot boss 128 (120' in FIG. 4) with respect to the rear truck assembly 120 to thereby steer the toy skateboard device 80.

A pair of rollers 174 are rotatably connected to a lower rear end of the board lower housing 88 through fasteners 176 that extend through the rollers and preferably thread into bosses 178 extending laterally from the housing 88. The rollers 174 are adapted to contact the ground when the front truck assembly 91 leaves the ground during a "wheelie" maneuver.

Another drive unit in the form of a torso drive unit 180 is mounted in the compartment 162 and includes a servo housing 182 with a cover plate 186 that encloses an interior 184 of the housing 182. Another electrically operated actuator, such as a servomotor 188, is mounted in the housing interior 184 and includes a first rotary shaft 190 that mounts a pinion gear 192. Combo gears 194, 196 and 198 are rotatably mounted on posts 200, 204 and 206, respectively, formed in the housing interior 184. The combo gear 194 meshes with the pinion gear 192, while the combo gear 196 meshes with the combo gears 194 and 198. Preferably, the pinion gear is constructed of brass and the combo gears are constructed of brass and nylon. A rotary output includes a post 207 mounted to the housing 182 through a threaded fastener 208 and washer 210. A clutch plate 212 is mounted on the post 207 and is normally biased away from a bottom of the housing 182 by a spring 214. An output clutch gear 216 is mounted to the post 207 between the clutch plate 212 and a spacer 218. The clutch gear 216 is adapted to mesh with the gear 198 to thereby rotate the post 207 in response to rotation of the servo shaft 190.

A rotary drive shaft 220 is connected at one end to the post 207 through a lower U-joint 222 and at the other end to upper torso rotation plate 224 through an upper U-joint 226. Preferably, the upper and lower rotation plates 224, 228 are constructed of Delrin or other suitable material. Arm support rods 230 extend from opposite sides of the upper rotation plate 224. A contact ball 232 is mounted to an outer free end of each support rod 230. A head support rod 234 also extends upwardly from the upper rotation plate 224. Preferably, the support rods 230, 234 are formed of fiberglass tubing, but may be formed of solid and/or flexible materials. The contact balls 232 can be formed of nylon or other material. The support rods may support a toy figure constructed of fabric and filler material. Alternatively, the toy figure may be constructed of plastic material in a clamshell arrangement, as shown, for example, in FIG. 7.

A battery pack 240, such as a foldable battery pack, is positioned in a compartment 242 for powering the motors, receiver, and electronic circuitry related thereto. See U.S. Pat. No. 5,853,915 incorporated by reference herein. A battery access door 244 is removably mounted to the board upper housing 86 for covering the compartment 242. A latch 246 cooperates with the door 244 and the board upper housing 86 to keep the door 244 in a normally closed position.

As in the previous embodiment, the travel direction, travel velocity, and rotation of the torso portion can be remotely controlled through radio frequency or the like.

With reference now to FIGS. 7 to 34, a toy skateboard device 300 according to a third embodiment of the invention is illustrated. With particular reference to FIGS. 7 to 10, the toy skateboard device 300 includes a skateboard 302. The skateboard 302 includes an elongated board or platform 306 with a front truck assembly 308 and rear truck assembly 310 that extend transversely to the platform and that are connected to an underside of the platform 306. A toy figure 304 is mounted on the platform 306 of skateboard.

Figure 10:
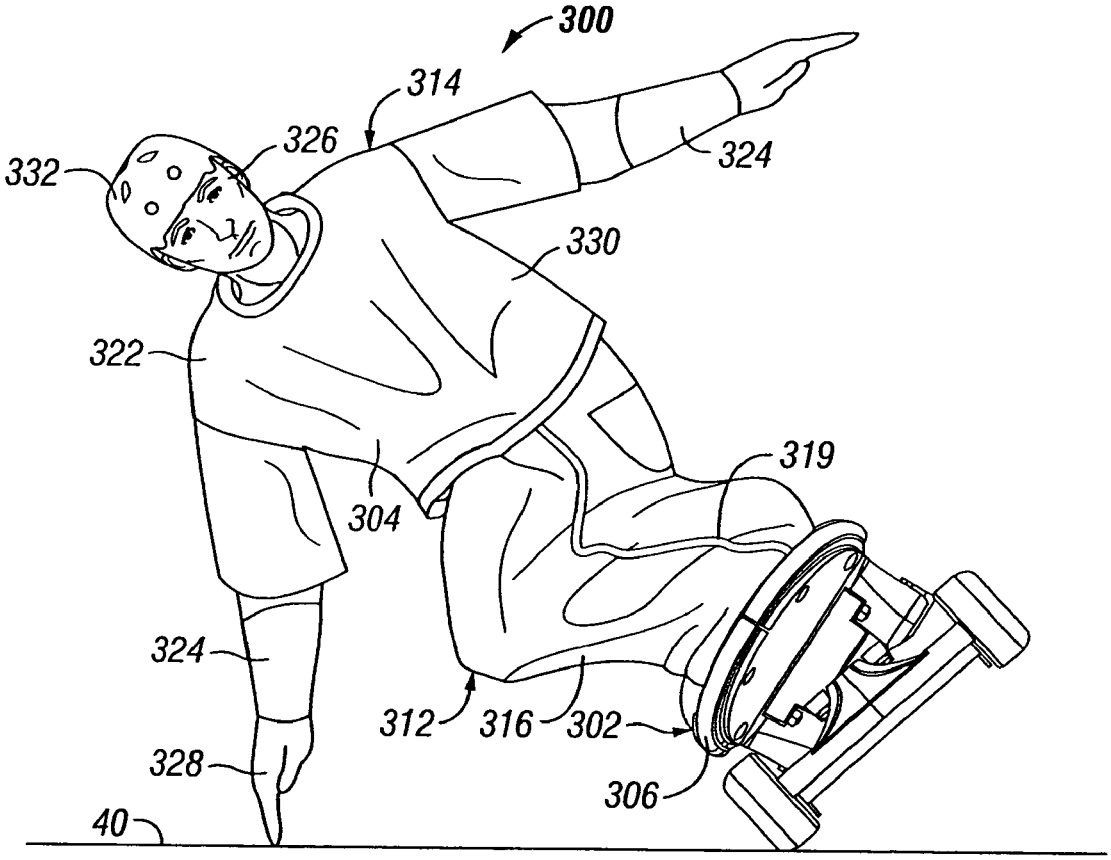
FIG. 10 is a front elevational view of the toy skateboard device with the toy figure in the FIG. 9 position and an arm of the toy figure touching a support surface.

The toy figure 304 includes a lower body portion 312 that is preferably fixedly (i.e. non-movably) mounted on the platform 306 and an upper body portion 314 that is preferably pivotally mounted to the lower body portion 312. The lower body portion includes legs 316, shoes 318, and a hip portion 320 (FIG. 8) that are formed as shell halves with a separation or seam line 319 (FIG. 10) that extends generally along a longitudinal centerline of the skateboard device 300. The upper body portion 314 includes a torso portion 322 with arms 324 and a head 326 extending therefrom. The upper body portion 314 is also preferably formed as shell halves with a separation or seam line 325 (FIG. 7) that extends generally along a longitudinal centerline of the skateboard device 300. Hands 328 are preferably formed separately and attached to the torso portion 322. As shown in FIG. 10, the hands 328 are adapted to contact a support surface 40 during skateboard maneuvers, and therefore are preferably constructed of a more durable and wear-resistant material than the arms and torso portion. Accessories, such as a fabric-type shirt 330 and a safety helmet 332 can be worn by the toy figure 304 to give a more realistic appearance.

Figure 7:
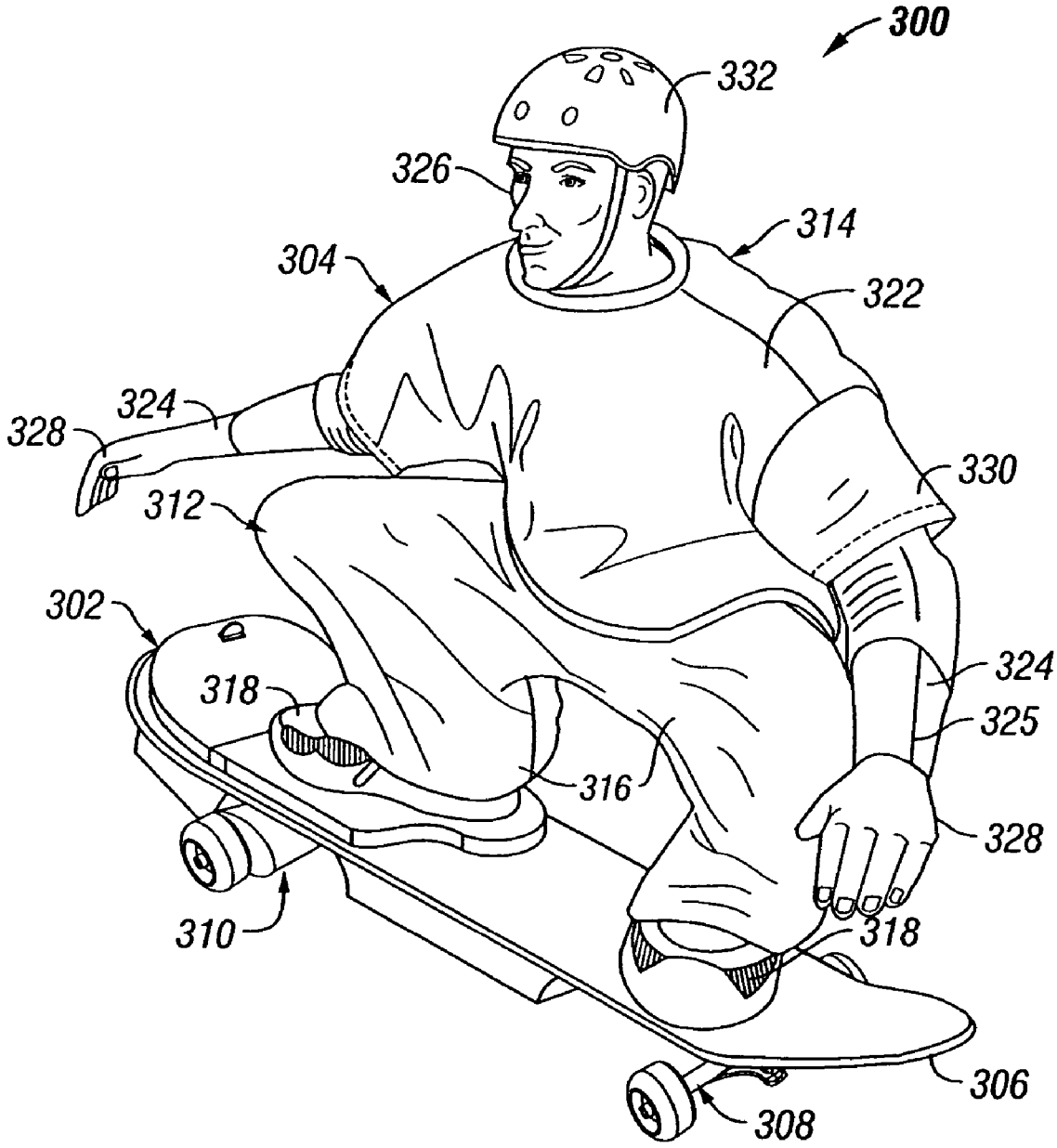
FIG. 7 is a front perspective view of a toy skateboard device according to a third embodiment of the present invention.
Figure 8:
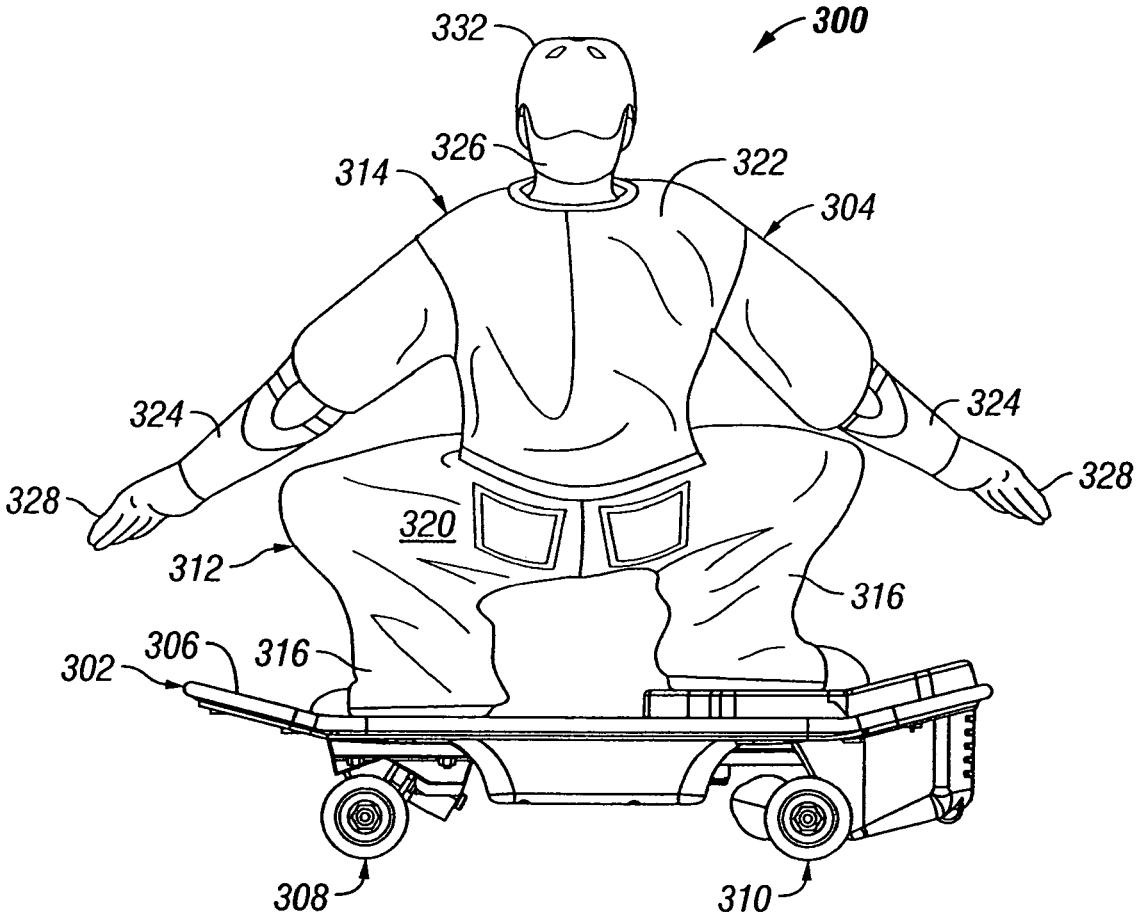
FIG. 8 is a rear elevation view of the toy skateboard device of FIG. 7.
Figure 9:
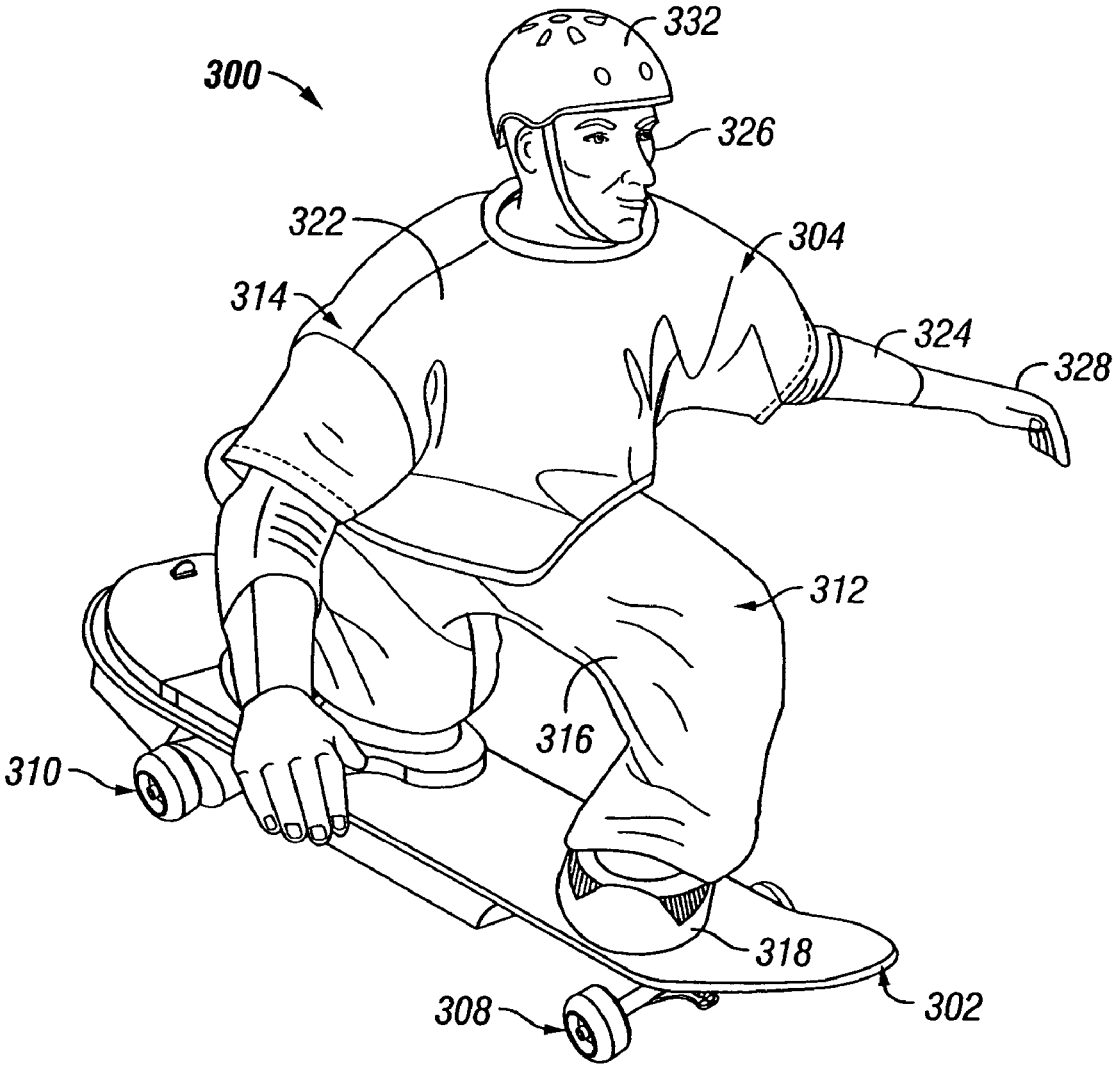
FIG. 9 is a front perspective view of the toy skateboard device of FIG. 7 with a head, torso and arm portions of the toy figure rotated to a far left position.

As shown in FIGS. 7 and 8, the upper body portion 314 is facing in the same direction as the lower body portion 312, and therefore is in a center position. However, as shown in FIGS. 9 and 10, the upper body portion 314 is twisted to a far left position with respect to the lower body portion 312. According to a preferred embodiment of the invention, the upper body portion 314 is rotatable between far left and far right positions, and can be stopped at various positions therebetween through user input, as will be described in greater detail below.

Figure 11A:
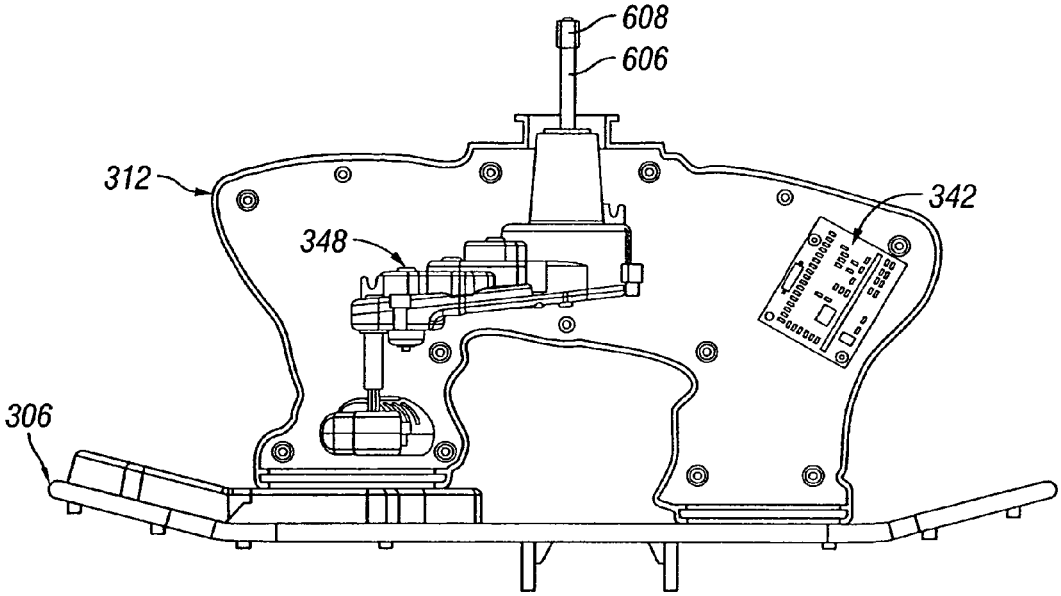
FIG. 11A shows inner electronic and mechanical components mounted in a lower shell portion of the toy figure.
Figure 11B:
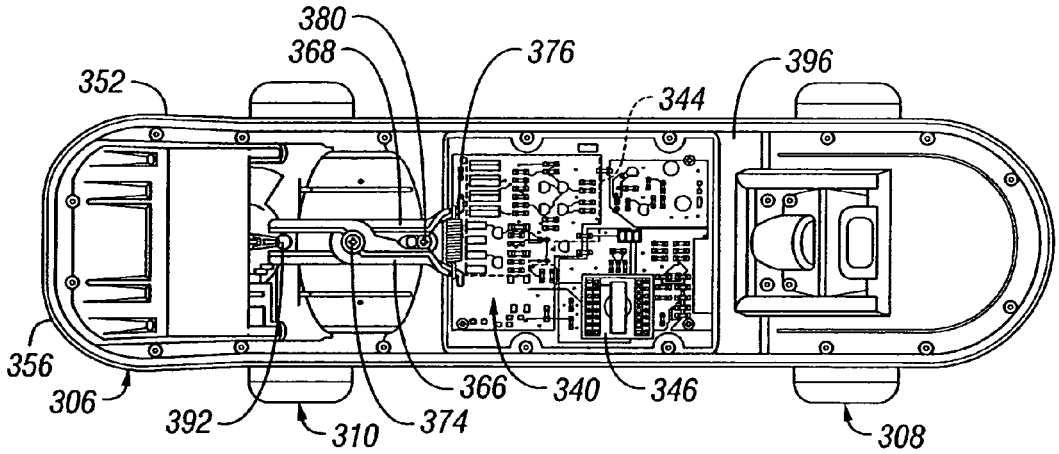
FIG. 11B shows further inner electronic and mechanical components mounted in the skateboard.

As shown most clearly in FIGS. 11A and 11B, an on-board control unit includes a main circuit board 340 located in the skateboard 302 and a radio receiver circuit board 342 located in the lower body portion 312 away from the main circuit board 340 in order to minimize noise due to motor actuation and/or other interference. Electrical wires (not shown) preferably extend between the circuit boards 340 and 342 so that signals received by the circuit board 342 from a remote control transmitter (e.g. 450 in FIG. 35) can be directed to the main circuit board 340. The main circuit board 340 preferably includes motor control circuitry 344, a microcontroller 346, and other related circuitry for operating the rear truck assembly 310, a first drive unit in the form of a steering mechanism 362 (FIG. 12) located in the skateboard 302, and another drive unit in the form of a torso drive mechanism 348 located in the lower body portion 312 in response to the signals received by the circuit board 342.

With reference now to FIGS. 12 to 17, the skateboard platform 306 includes a board upper housing 350, a board lower housing 352, and a bumper 354 that is positioned between the upper and lower board housings. The bumper 354 preferably extends around the upper rim 356 of the board lower housing 352 and the periphery 358 of the board upper housing 350. The upper and lower housings are preferably secured together through fasteners (not shown) or other well-known fastening means, such as adhesive bonding, ultrasonic welding, and so on.

The front truck assembly 308 is pivotally connected to the underside of the board lower housing 352 through a front saddle bracket 360 to rotate about an axis that extends in an elongated direction of the deck and that is pitched between vertical and horizontal more closely approximating real skateboards than does a vertical axis. Horizontal is represented by a level surface supporting all four wheels of the stationary skate board 302. The rear truck assembly 310 is also pivotally secured to the underside of the board lower housing 352 to also rotate about an axis 310' (see FIG. 13) extending in an elongated direction of the deck and angled or pitched between vertical and horizontal. The angle of the pivot of platform 306 on rear truck assembly 310 (i.e. about axis 310') affects the turning radius of the skateboard device 300 and is changed through a steering mechanism 362 that is positioned in a rear compartment 364 of the board lower housing 352. A pivot pin 374 is located on the board lower housing 352 forward of the compartment 364. A left trim arm 366 and a right trim arm 368 are pivotally connected to the boss 374 through bores 370 and 372, respectively, formed in the trim arms. As shown in FIG. 11B, the trim arms 366 and 368 are biased toward a center position through a tension spring 376 that extends between the trim arms. An adjusting post 378 fits within a hollow boss 380 formed on the board lower housing and extends between the trim arms 366 and 368. The post 378 can be accessed from underneath the board lower housing through an adjustment knob 379 to adjust the center position of the trim arms after assembly of the device 300.

An outer steering gear 382 is mounted on a drive pivot boss 384 of the rear truck assembly 310. The outer steering gear 382 meshes with a rotary output of the steering mechanism 362 in the form of an outer steering gear 386. A centering arm 388 includes a collar portion 390 that is mounted on the drive pivot boss 384 and an arm portion 392 that extends generally upwardly from the collar portion. An upper end of the arm portion 392 is positioned between the trim arms 366 and 368, opposite the adjusting post 378. The outer steering gear 382 and the centering arm 388 are held in place on the drive pivot boss 384 through a retaining ring 394 that locks with the boss 384.

When the steering mechanism 362 is actuated, rotation of the output gear 386 in one direction causes relative rotation, and thus tilt, between the rear truck assembly 310 and the board lower housing 352 against bias pressure from bias spring 376 through one of the trim arms 366, 368. When power to the steering gear train assembly 362 is turned off, the spring 376 returns the rear truck assembly 310 to its normal (central) position through the one trim arm. Likewise, rotation of the output gear 386 in the opposite direction causes relative rotation in the opposite direction, and thus tilt, between the rear truck assembly 310 and the board lower body portion 312 against bias from the other trim arm. Again, the other trim arm returns the rear drive assembly 310 to its normal position when power to the steering gear train assembly is turned off.

Figure 18A:
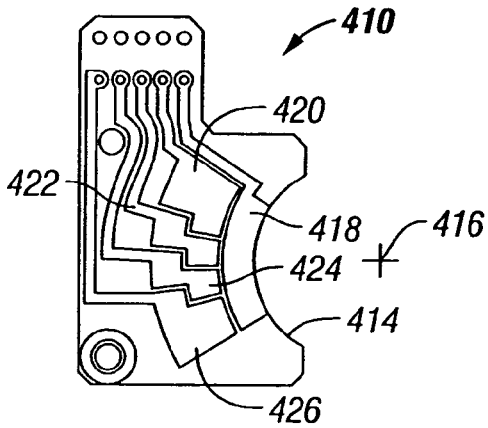
FIG. 18A shows a circuit board according to the present invention for determining the steering position.
Figure 18B:
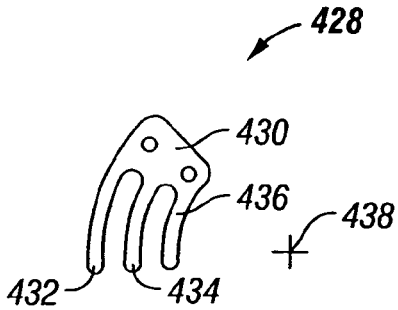
FIG. 18B shows a wiper arm for use with the circuit board of FIG. 18A.

With additional reference to FIGS. 18A and 18B, a steering position feedback board 410 is preferably mounted to a forward wall 412 (FIG. 12) of the rear compartment 364. The board 410 has a curved portion 414 with a center of radius 416 that is coaxial with a rotational axis of the drive pivot boss 384. A plurality of coplanar conductive pads 418, 420, 422, 424, and 426 are formed on the board 410. Preferably, the board 410 is a printed circuit board and the conductive pads are formed on the circuit board through etching, screening, or other well-known techniques. A wiper 428 is mounted on the outer steering gear 382 for rotation therewith and with the rear truck 310 about the rotational axis 310' of the drive pivot boss 384. The wiper 428 is preferably stamped or otherwise formed from conductive metal and includes three contact fingers 432, 434 and 436 extending from a mounting portion 430. The fingers are preferably curved with a center of radius 438 that is coincident with the rotational axis 310' of the drive pivot boss 384. The contact finger 436 slides in an arcuate path along the conductive pad 418, while the contact fingers 432 and 434 slide in an arcuate path along the conductive pads 420, 422, 424, and 426. The pad 418 may be connected to either ground or a positive voltage, while the pads 420, 422, 424 and 426 are connected to a separate input port of the microcontroller for delivering a logical high or low signal. Alternatively, the pads 420–426 may be multiplexed or serially gated into a single input port for indicating the relative angular position between the steering feedback board 410 and the wiper 428, and thus the tilt angle between the rear drive assembly 310 and the board upper and lower housings 350 and 352.

Figure 12:
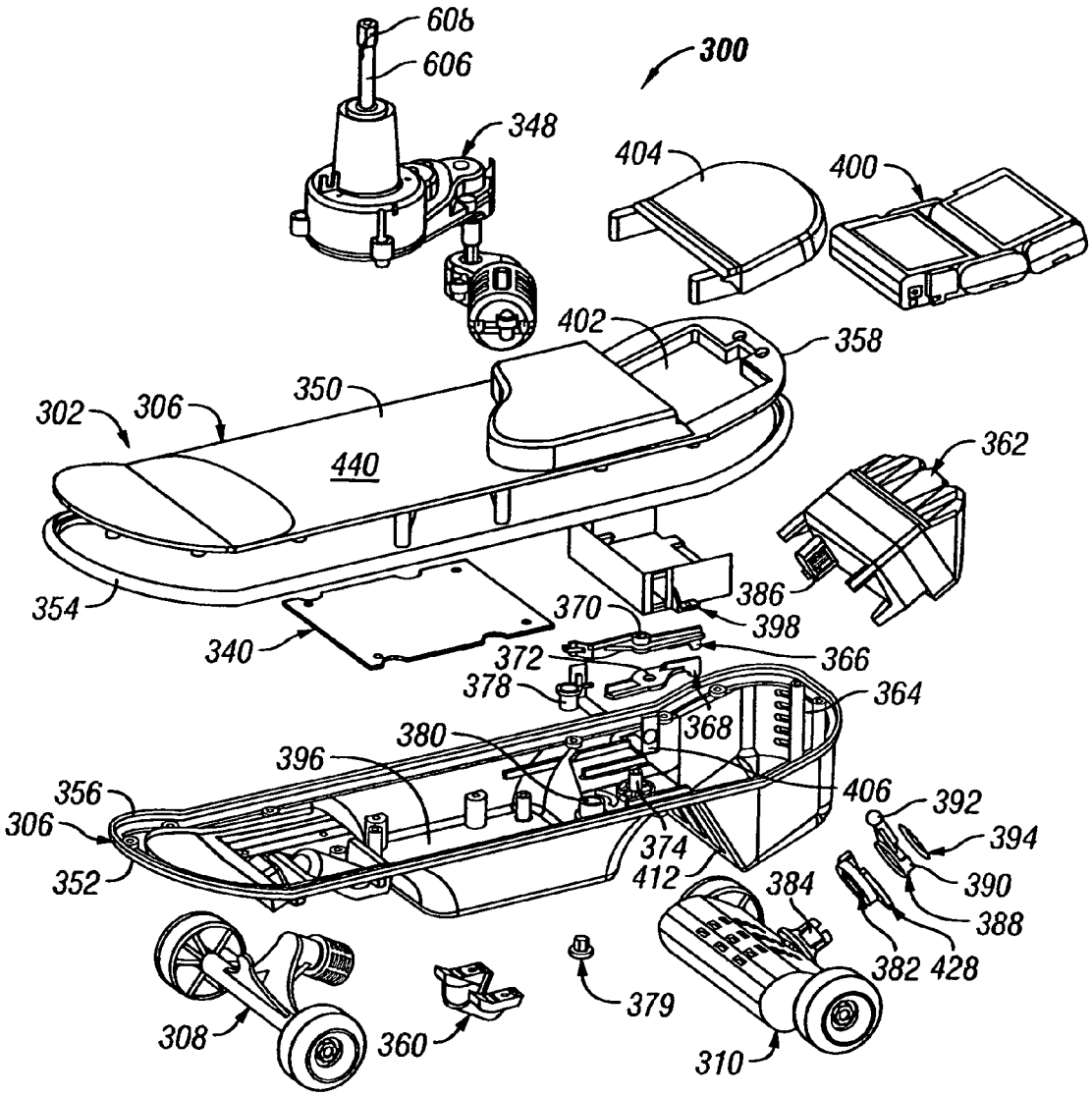
FIG. 12 is an exploded isometric view of the skateboard device according to the third embodiment of the invention with the toy figure removed.
Figure 13:
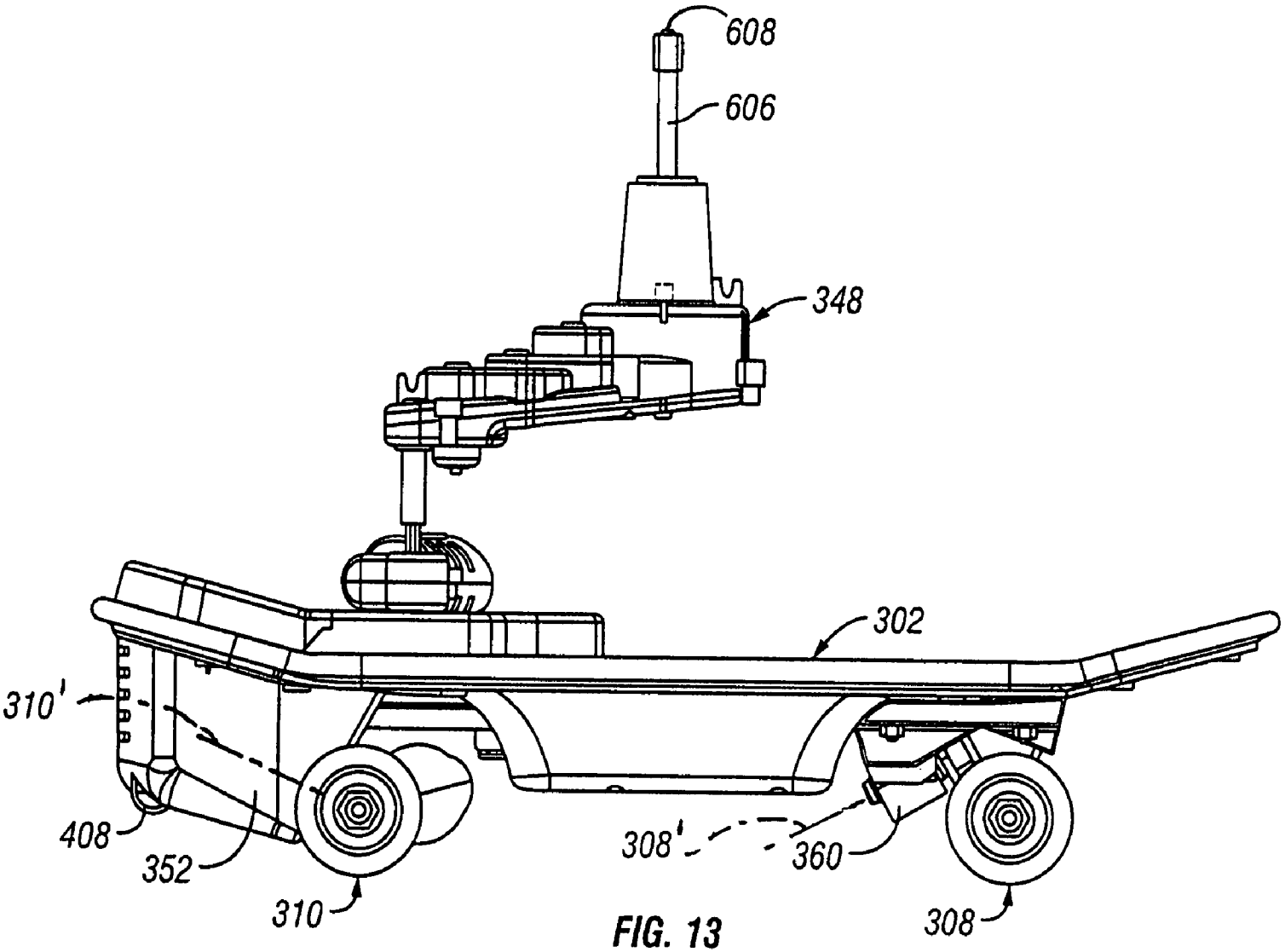
FIG. 13 is a right side elevational view of the skateboard device third embodiment.

In operation, the fingers 432 and 434 will normally be in electrical contact with the pads 424 and 422, respectively, where the rear drive assembly 310 is oriented generally parallel to the board upper surface 440 (FIG. 12). In this position, and by way of example, a logical "high" for the pads 422 and 424 is transmitted to separate ports of the microcontroller, indicating that the rear drive assembly 310 is "centered." As the relative angle or tilt between the rear drive assembly 310 and the upper surface 440 of the board upper housing 350 occurs, such as a tilt in the clockwise direction as viewed from a forward end of the skateboard device 300 (FIG. 16), the fingers 432 and 434 will travel in a clockwise direction. When both fingers 432 and 434 are positioned on the pad 422, a logical "high" associated with only the pad 422 is sent to the appropriate port of the microcontroller, indicating that the rear drive assembly 310 is "tilted" to a "soft left" position. Likewise, when the finger 432 contacts the pad 422 and the finger 434 contacts the pad 420, the microcontroller determines that the rear drive assembly is tilted to a "medium left" position. Finally, with both fingers 432, 434 contacting the pad 420, the microcontroller determines that the rear drive assembly is tilted to a hard left position. Thus, there are three discrete left tilt positions from the center position. Likewise, there are three discrete right tilt positions from the center position for a total of seven discrete positions that can be detected by the microcontroller. The discrete positions are used in conjunction with a steering control joystick 452 of a transmitter 450 (FIGS. 34 and 35). The joystick 452 is attached to electrical wipers (not shown) which ride along conductive pads (not shown) to form seven discrete joystick positions corresponding to the seven discrete tilt positions. By way of example, as the user moves the joystick 452 one step to the left, as referenced from a bottom 454 of the transmitter 450 in FIG. 35, a corresponding "soft left" tilt between the rear drive and the board housings will result. Movement of the joystick 453 to the next left position results in a corresponding "medium left" tilt, and so on. The right tilt control is similar in operation and therefore will not be further described. When the joystick 452 is released, the skateboard device 300 returns to the center or "straight travel" direction under return bias from the trim arms, as previously described. Of course, it is to be understood that more or less positions may be provided for the joystick 453 and/or the steering feedback system. Alternatively, an analog arrangement can be used for the joystick 453 and/or the steering feedback system.

As shown most clearly in FIG. 11B, the main circuit board 340 is received in a forward compartment 396 of the board lower housing 352. As shown in FIG. 12, a battery support housing 398 is positioned in the rear compartment 364 above the steering gear train assembly 362. A foldable battery assembly 400 is positioned in the housing 398. A battery access opening 402 in the board upper housing portion 350 is normally closed with a cover 404 that snap-fits into the opening 402. A battery contact 406 is located in the board lower housing 352 for connecting the battery to the electrical circuitry. Skid tabs 408 (FIG. 13) are formed on a lower rear portion of the board lower housing 352 to support "wheelie" maneuvers as previously described.

Figure 19:
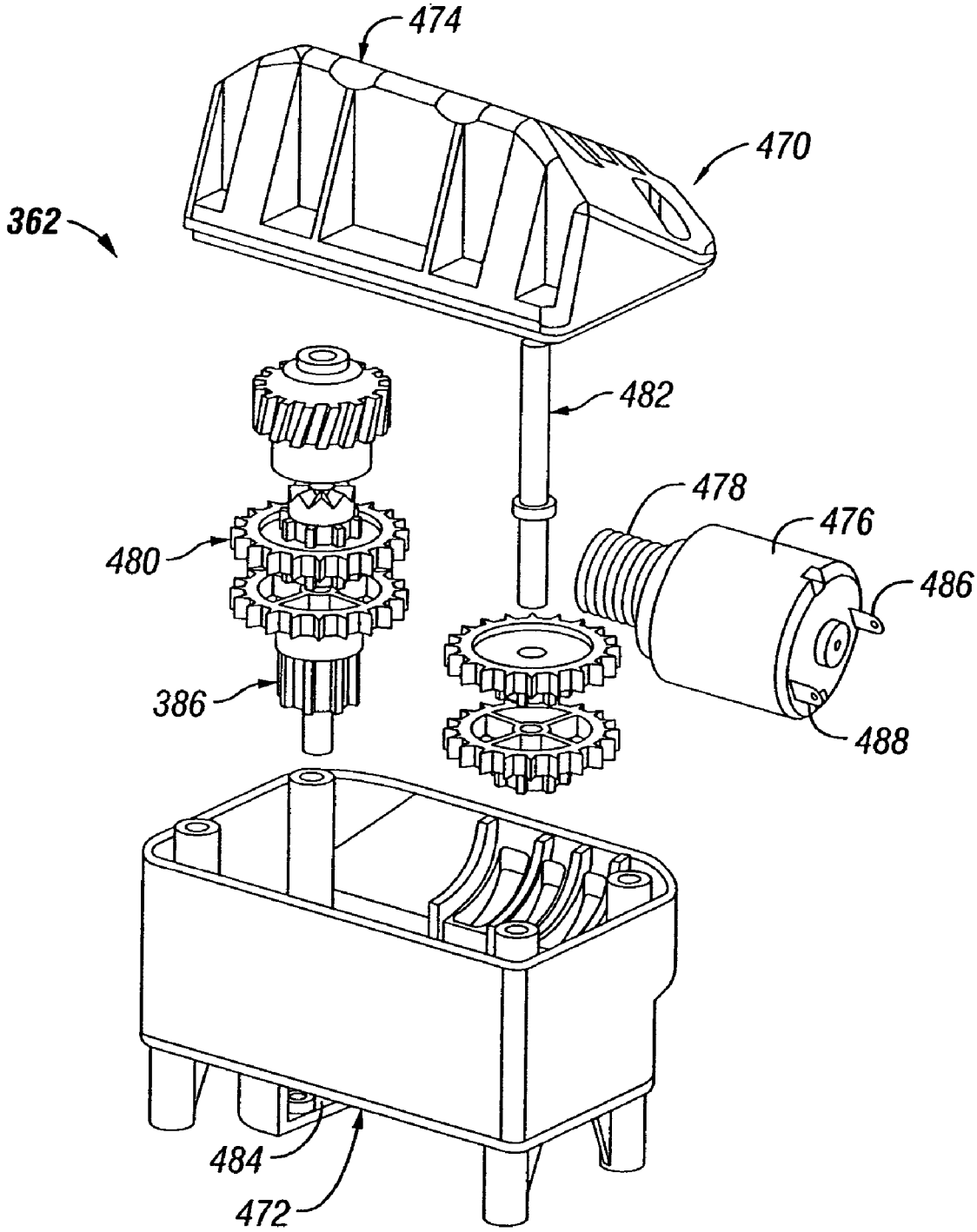
FIG. 19 is an isometric perspective view of a steering control assembly according to the present invention.

With reference now to FIG. 19, the steering mechanism 362 includes a housing 470 with a lower housing portion 472 connected to an upper housing portion 474. An electrically operated actuator, such as a servomotor 476 is mounted in the housing 470 and includes a worm gear 478 that is meshed with a reduction gear train 480, a portion of which is mounted on a shaft 482. The gear train 480 includes the outer gear 386 which is exposed through a window 484 in the lower housing portion 472 for meshing with the outer steering gear 382 (FIG. 12). The servomotor 476 includes electrical contacts 486, 488 which are connected to the circuit board 340 for actuating the servomotor 476 in response to input by the user, in conjunction with the microcontroller and the steering position feedback system previously described, to steer the skateboard device 300.

Figure 20:
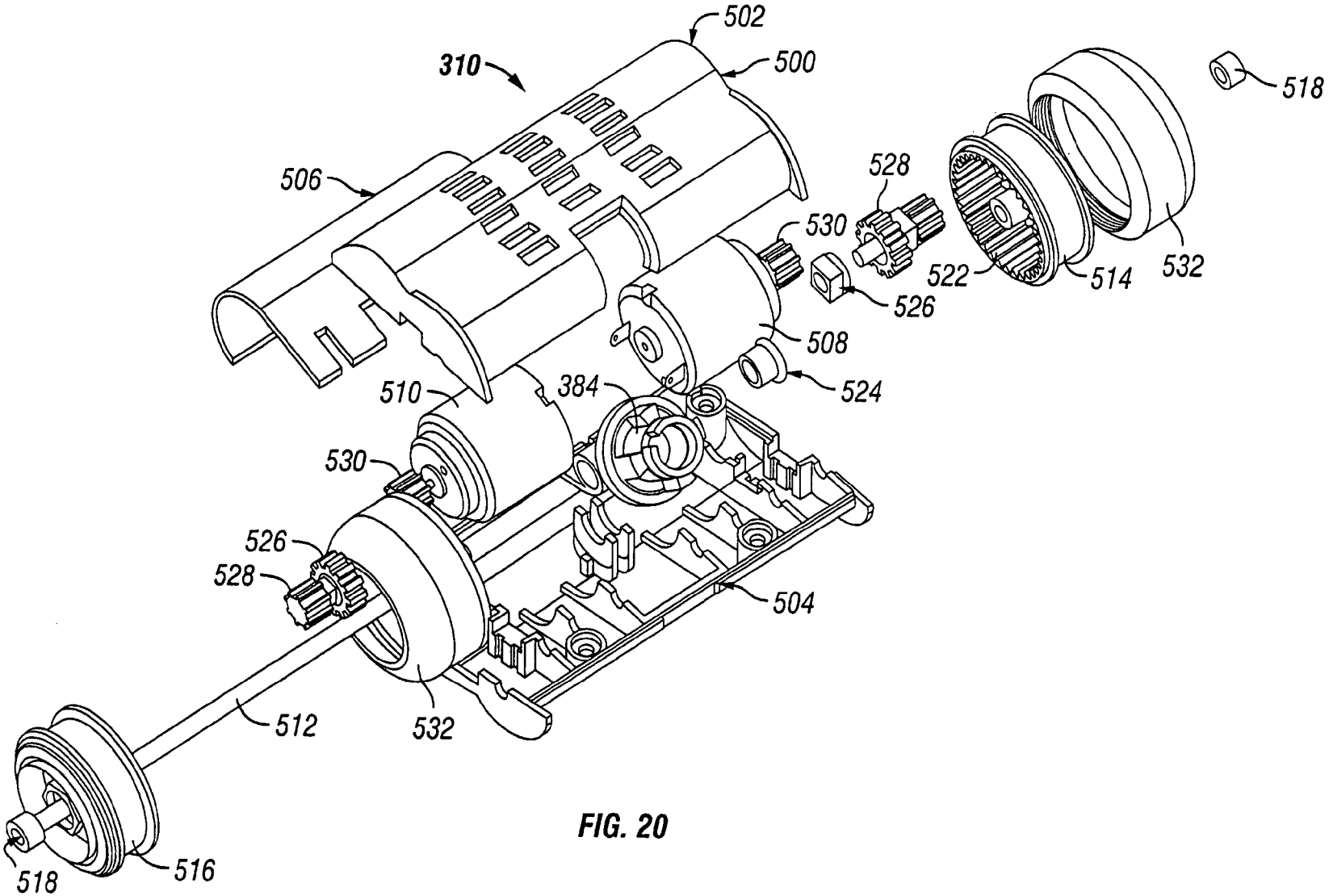
FIG. 20 is an exploded isometric view of a rear truck assembly according to the present invention
Figure 21:
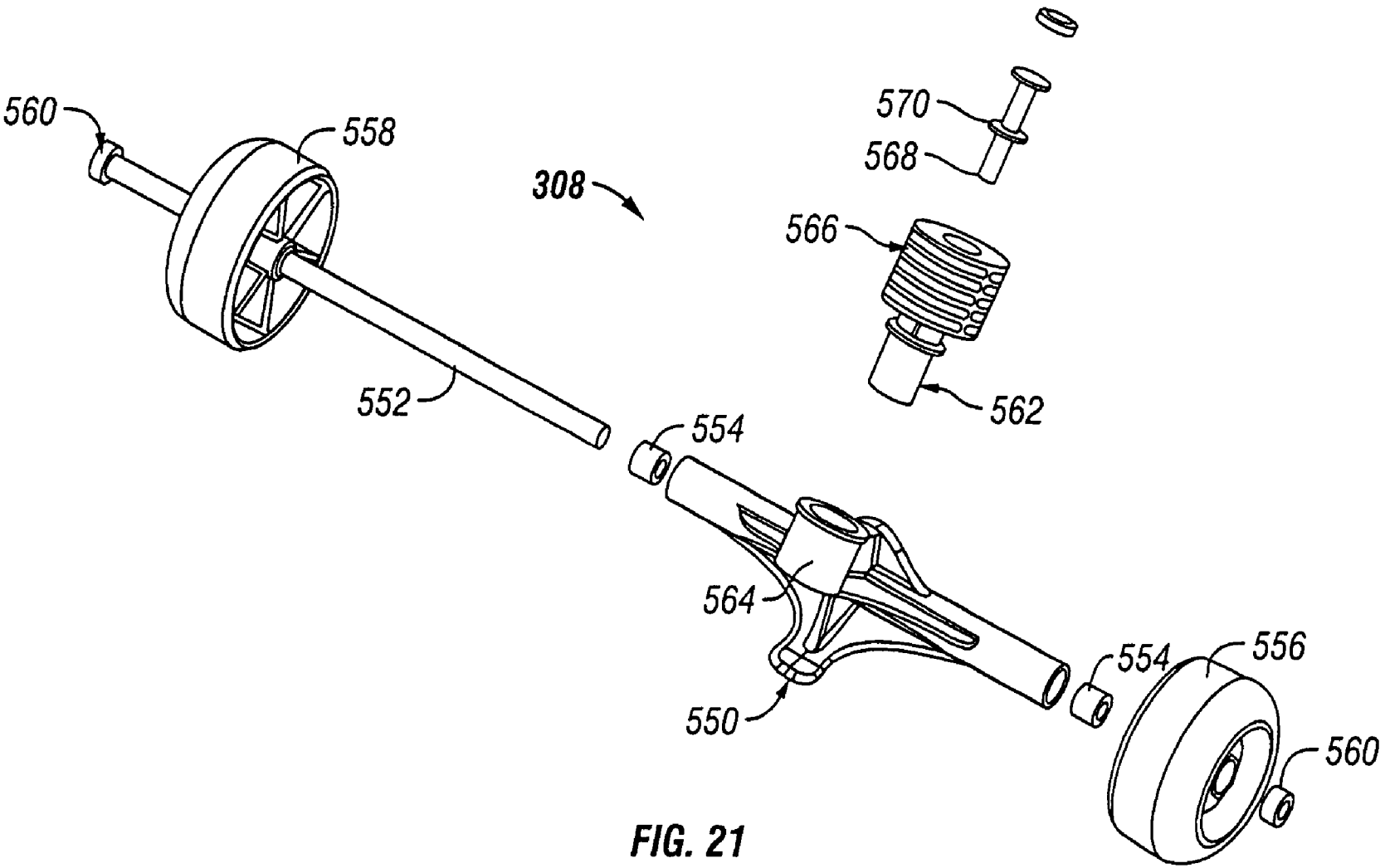
FIG. 21 is an exploded isometric view of a forward truck assembly according to the invention.
Figure 22:
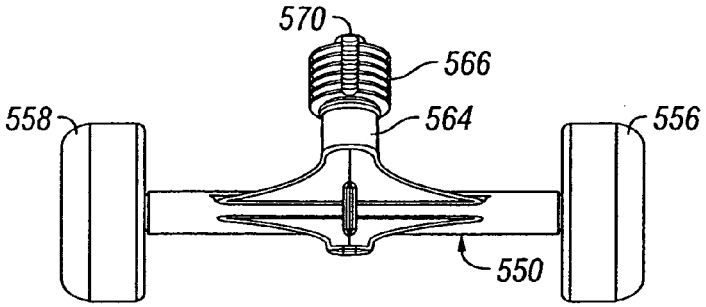
FIG. 22 is a front elevational view of the forward truck assembly of FIG. 21.
Figure 23:
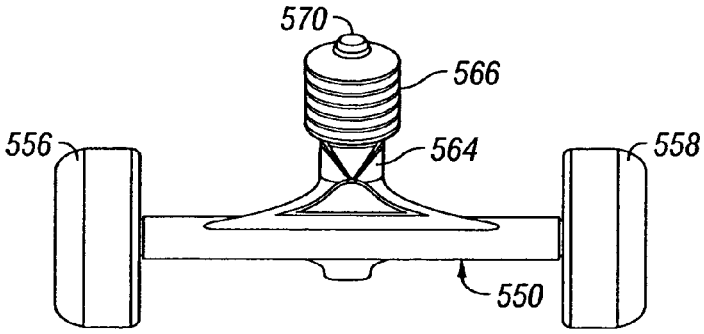
FIG. 23 is a rear elevational view of the forward truck assembly
Figure 24:
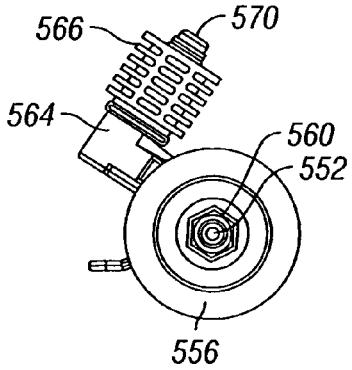
FIG. 24 is a side elevational view of the forward truck assembly
Figure 25:
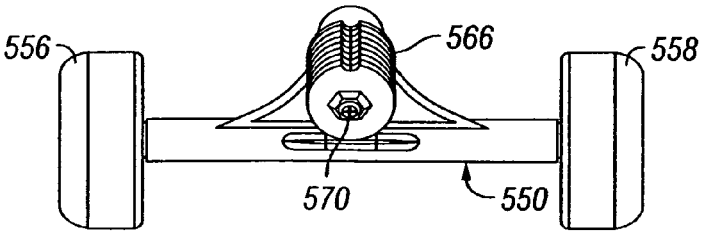
FIG. 25 is a top plan view of the forward truck assembly.

With reference now to FIG. 20, the rear truck assembly 310 has a housing 500 with an upper housing portion 502, a lower housing portion 504 connected to the upper housing portion, and a motor housing portion 506 connected to the upper and lower housing portions 502 and 504, respectively. A pair of oppositely facing rear wheel drive motors 508, 510 are located in the housing 500. A rear axle 512 extends transversely to the deck and through the housing 500 between gear wheels 514, 516. Retainers 518 can be press-fit onto the ends of the rear axle 512 to retain the gear wheels 514, 516 on the axle. The gear wheels 514 and 516 are rotatable with respect to the rear axle 512 and are driven by the motors 508 and 510, respectively, through a reduction gear train including an inner gear 522 formed in the gear wheels 514, 516, reduction gears 528, and motor gears 530. Axle bushings 524 support the rear axle 512 in the housing 500 and bearings 526 support the reduction gears 528 that mesh with the motor gear 530 and the inner gear 522. A rear tire 532 is mounted on each of the gear wheels 514 and 516. Preferably, the rear tires are constructed of a high friction material. With this arrangement, the wheels 514, 516 can be independently controlled, if desired, by the microcontroller through the independent drive motors 508, 510 to rotate at different rates, which is especially advantageous when the skateboard device 300 is turning since the distance traveled by the outside wheel is greater than the distance traveled by the inside wheel.

As shown in FIG. 35, the rotational direction and speed of the wheels 514, 516 of the rear truck assembly, and thus the direction and speed of the skateboard device 300, can be controlled by a user through a joystick 520 on the transmitter 450. The joystick 520 is preferably similar in construction to the joystick 452, with seven discrete control positions for neutral, three forward speeds, and three reverse speeds. Of course, it will be understood that more or less control positions may be used. Alternatively, an analog joystick may be used for continuous speed and/or direction control.

With reference now to FIGS. 21 to 25, the front truck assembly 308 includes a front axle housing 550 with a front axle 552 that extends transversely to the deck and through the front axle housing. Bushings 554 are positioned in the housing 550 between the front axle 552 and the housing. Wheels 556, 558 are mounted at opposite ends of the axle 552 for rotation with respect to the housing 550. Preferably, the wheels 556, 558 rotate independently of each other so that the skateboard device 300 can negotiate turns with greater facility. Retainers 560 are press-fit or otherwise installed on the ends of the front axle 552 for retaining the wheels 556, 558 on the front axle. A pivot boss 562 is rotatably received in a cylindrical portion 564 of the housing 550. A bushing 566, preferably constructed of flexible elastomeric material, is positioned on the pivot boss 562 and is retained thereon by a washer 570 and threaded fastener 568 that threads into the pivot boss 562. The diameter of the bushing can be increased or decreased by tightening or loosening the fastener 568, respectively. The bushing 566 is received in the front saddle bracket 360 (FIG. 12). Increasing the diameter of the bushing while received in the saddle bracket 360 causes more resistance to tilting between the board 306 and the front truck assembly 308, while decreasing the diameter results in less tilting resistance With reference now to FIGS. 26 to 33, the torso drive assembly 348 includes a gear housing 600 with an upper housing portion 602 connected to a lower housing portion 604 through fasteners (not shown) or the like. A rotary output in the form of a shaft 606 is located in the housing 600. An upper end 608 of the output shaft 606 extends out of the upper housing portion 602 through an upper bearing 610 that is mounted at the shaft exit point. The upper end 608 of the output shaft is fixedly secured to the upper body portion 314 (FIG. 7) through a securing nut 622 so that rotation of the output shaft causes rotation of the upper body portion 314 with respect to the lower body portion 312. A lower end 614 of the shaft 606 is received in a lower bearing 615 installed in the lower housing portion 604. A partial spur gear 612 is mounted on the lower end 614 of the shaft 606 above the lower bearing 615. A threaded fastener 617 or other connection means secures the spur gear 612 to the shaft 606. The spur gear 612 preferably extends over an angle of approximately 180 degrees and is driven by a reduction gear train 616 to thereby rotate the output shaft 606, and thus the upper body portion 314, through approximately 180 degrees.

The reduction gear train 616 includes a first compound gear 620 that is mounted for rotation on a first gear shaft 621 that fits in a boss 623 of the lower housing portion 604. The first compound gear 620 includes an upper gear portion 622 that meshes with the spur gear 612 and a lower gear portion 624. A second compound gear 626 is mounted for rotation on a second gear shaft 627 that fits in a boss 629 of the lower housing portion. The second compound gear 626 includes a lower gear portion 628 and an upper gear portion 630 that meshes with the lower gear portion 624 of the first compound gear 620. A third compound gear 632 includes a lower gear portion 636 and an upper gear portion 634 that are mounted for rotation on a third gear shaft 635 that fits in a boss 631 of the lower housing portion. The upper gear portion 634 meshes with the lower gear portion 628 of the second compound gear 626. The upper gear portion 634 includes axially extending lower teeth 638 that engage axially extending upper teeth 640 of the lower gear portion 636. The teeth 638, 640 form a clutch mechanism that slips when torque on the third gear set 632 is above a predetermined limit, such as when the spur gear 612 contacts a mechanical stop (not shown) on the housing 600 at the end of its travel. In this manner, the torso drive mechanism 348 is less likely to fail. A fourth compound gear 641 extends through the lower housing portion 604 and includes a lower gear portion 642 and an upper gear portion 644. A splined shaft 646 of the lower gear portion 642 is received within a grooved tube 648 of the upper gear portion 644 for mutual rotation. The upper gear portion 644 meshes with the lower gear portion 636 of the third compound gear 632. A motor, such as a servomotor 650 is located in a motor housing 652 that includes an upper motor housing portion 654 and a lower motor housing portion 656. The tube 648 and shaft 646 extend through an opening 658 in the upper motor housing portion 654. A worm gear 660 is mounted on a shaft 662 of the motor 650 and meshes with the lower gear portion 642.

Figure 34A:
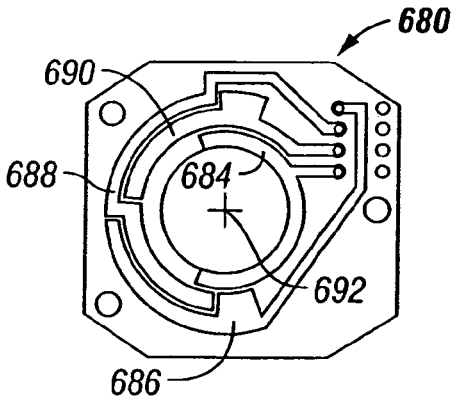
FIG. 34A shows a circuit board according to the present invention for determining the rotational position of the upper portion of the toy figure with respect to the skateboard.
Figure 34B:
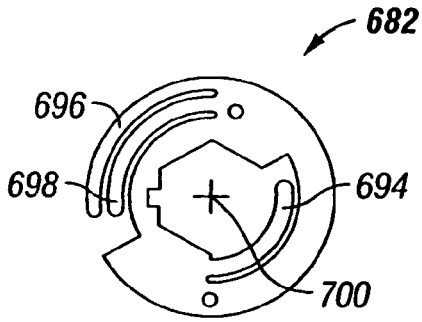
FIG. 34B shows a wiper arm for use with the circuit board of FIG. 34A.
Figure 26:
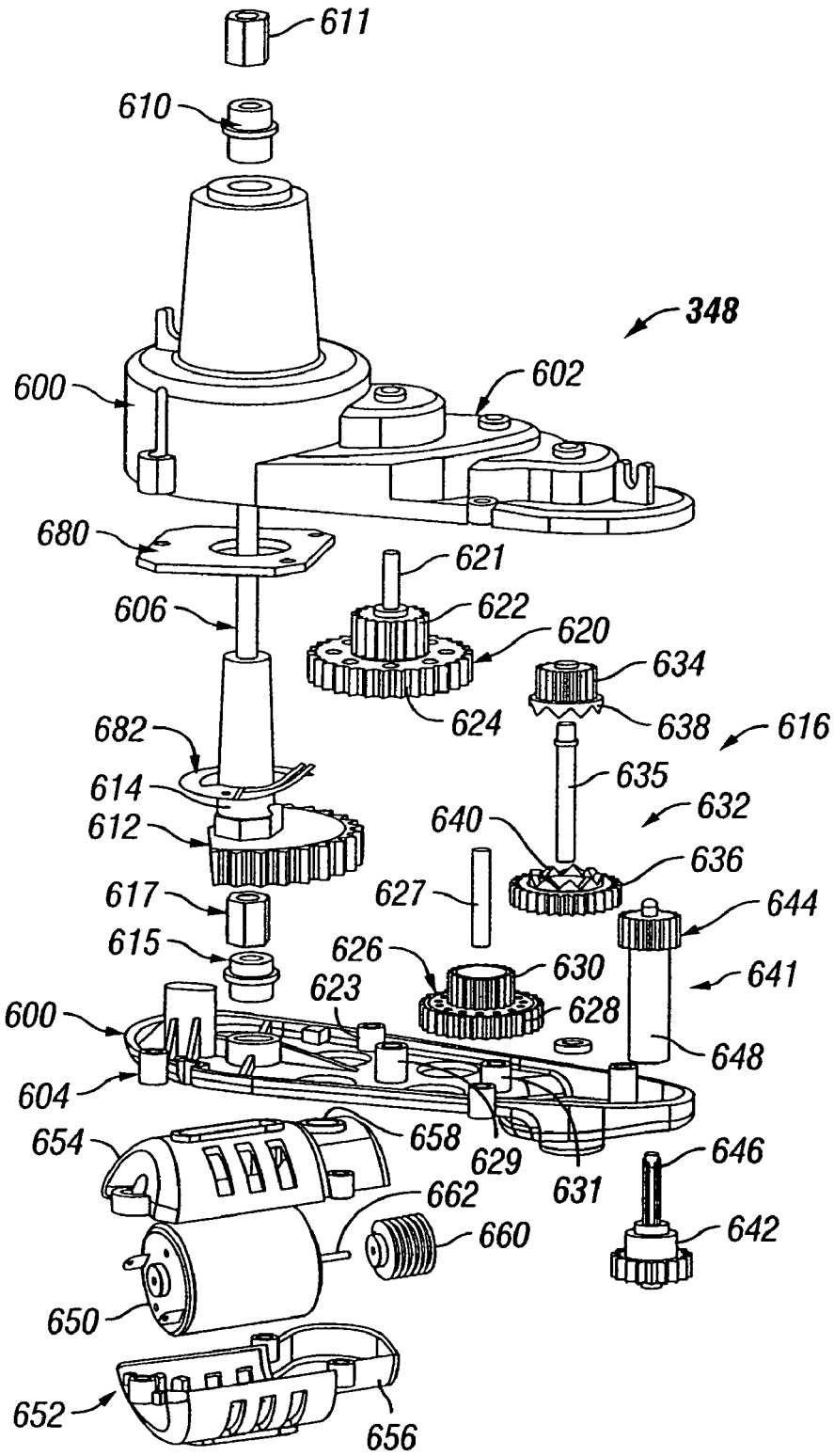
FIG. 26 is an exploded isometric view of a torso drive assembly according to the third embodiment for rotating the upper portion of the toy figure with respect to the skateboard.
Figure 27:
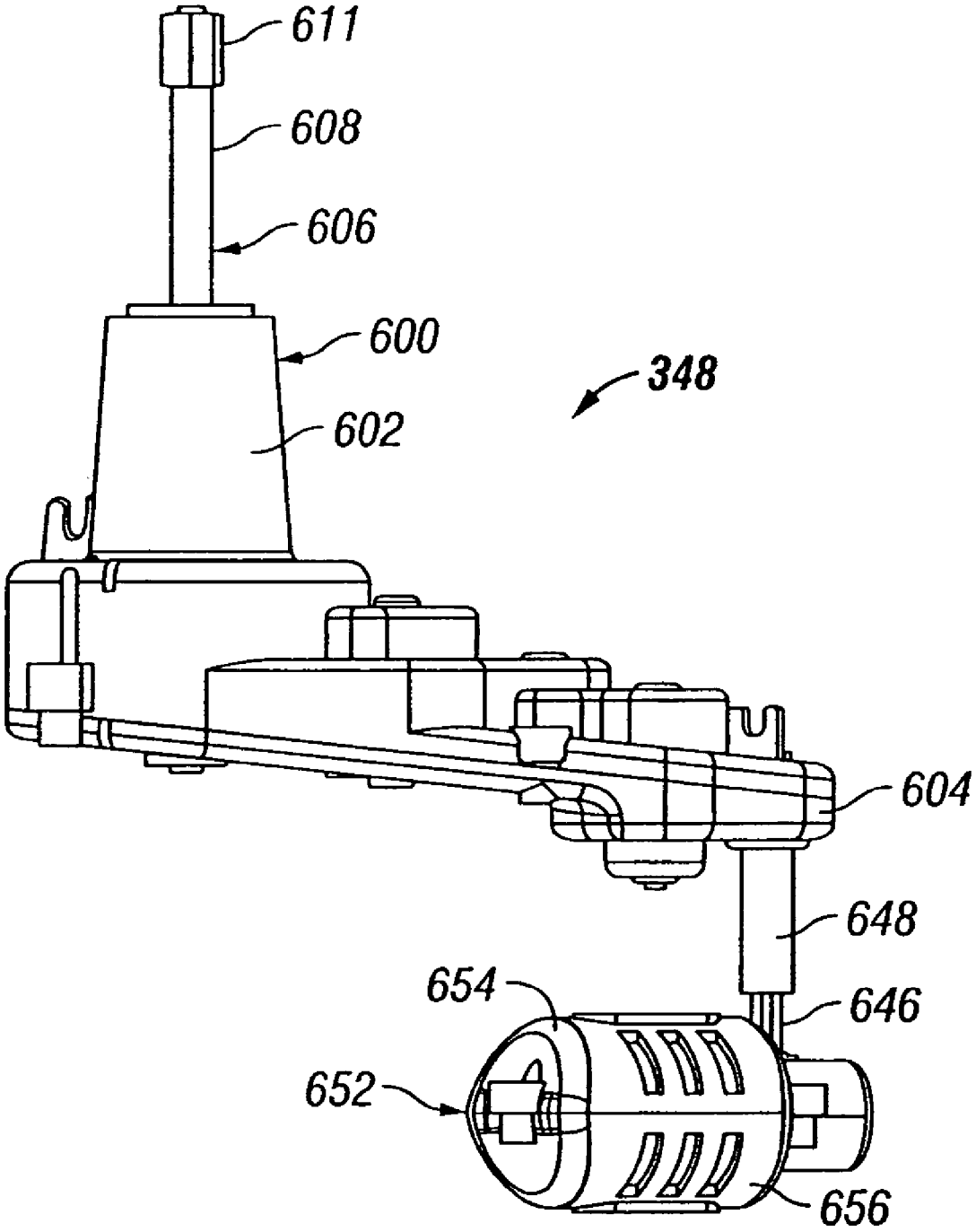
FIG. 27 is a right side elevational view of the torso drive assembly of FIG. 26.
Figure 28:
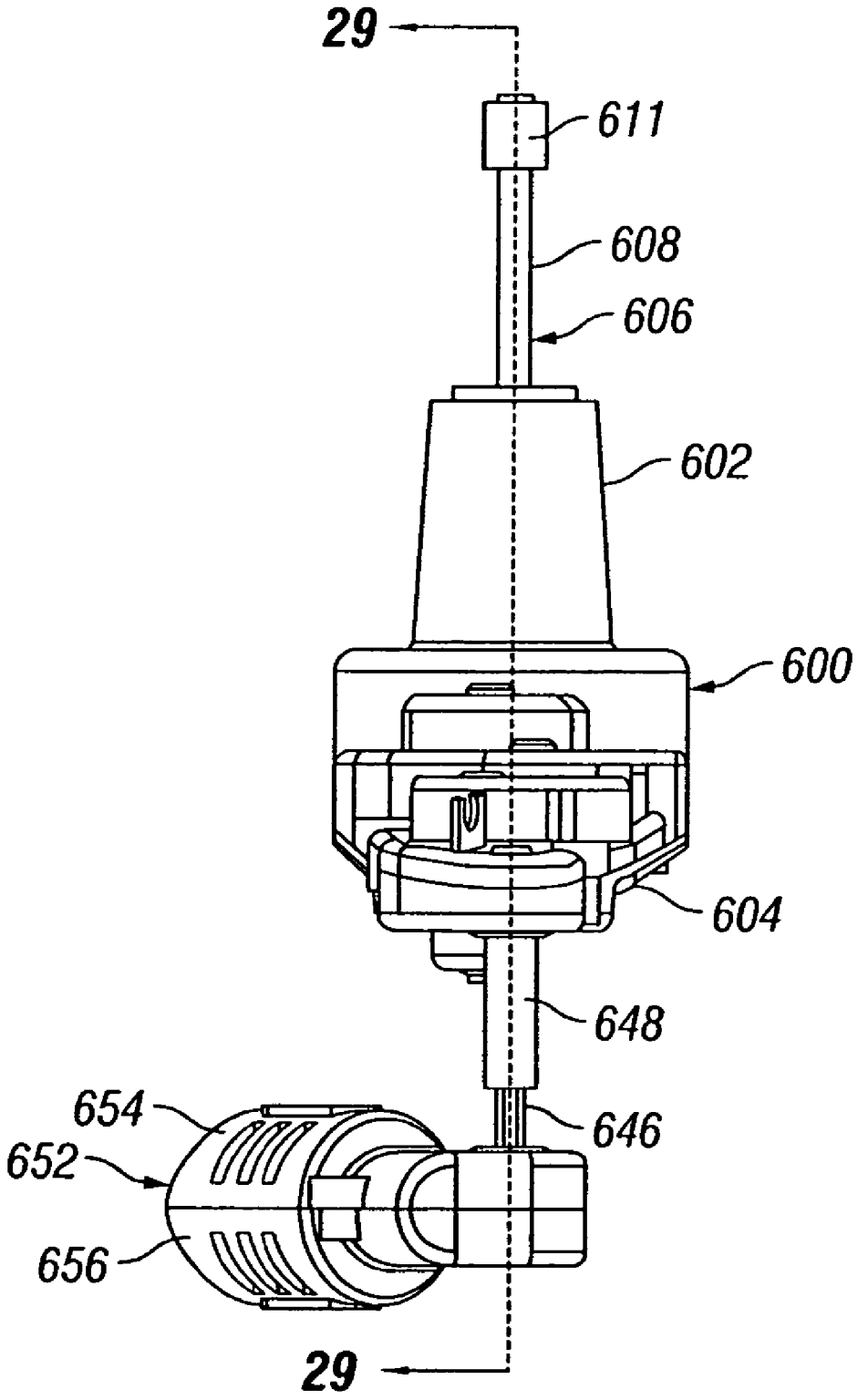
FIG. 28 is a front elevational view of the torso drive assembly.
Figure 29:
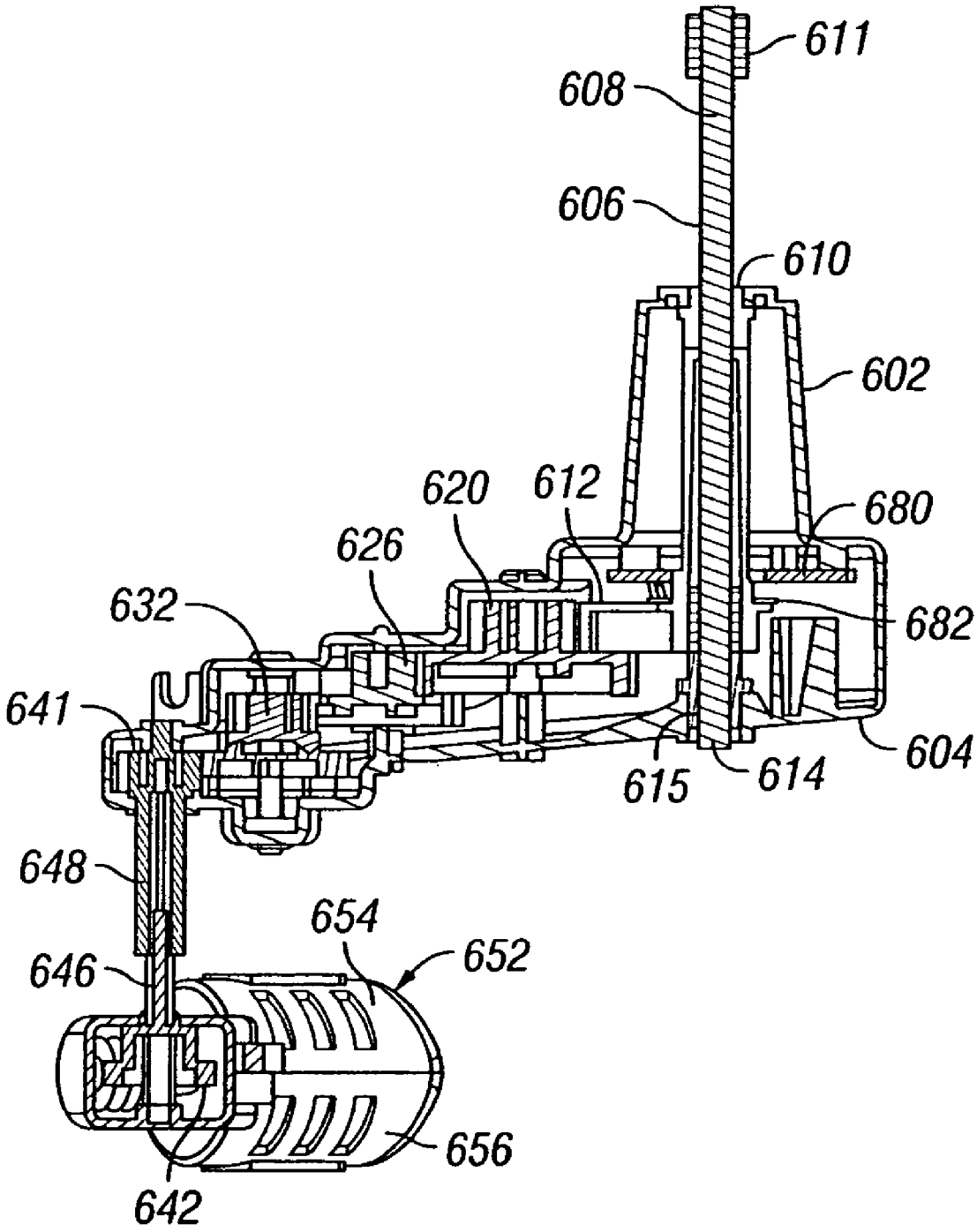
FIG. 29 is a cross section of the torso drive assembly taken along line 29—29 of FIG. 28.
Figure 30:
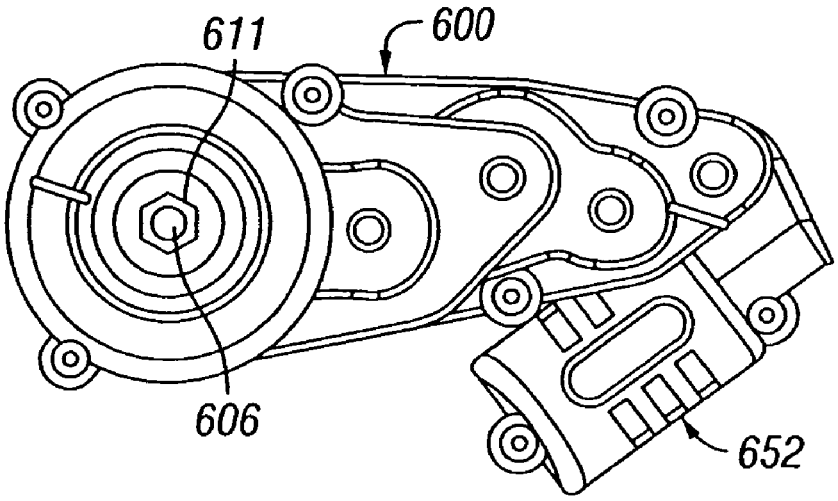
FIG. 30 is a top plan view of the torso drive assembly.
Figure 31:
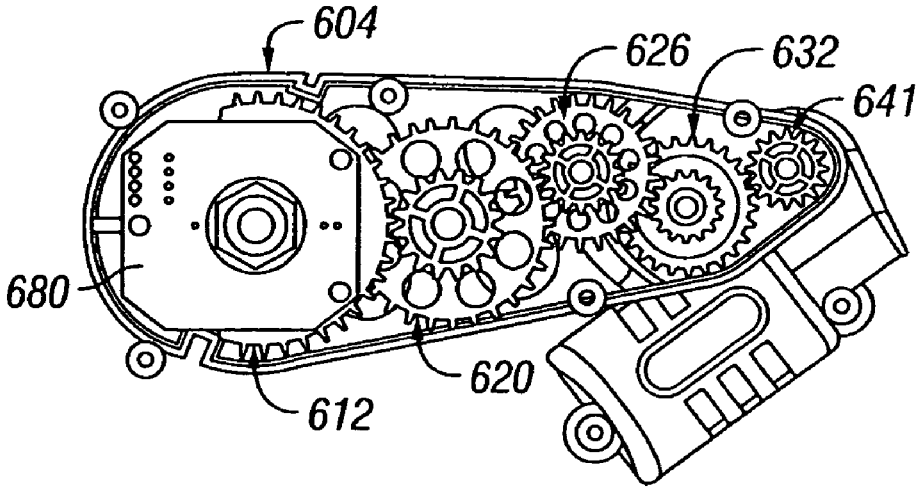
FIG. 31 is a top plan view of the torso drive assembly with an upper cover removed to reveal a gear train of the drive assembly.
Figure 32:
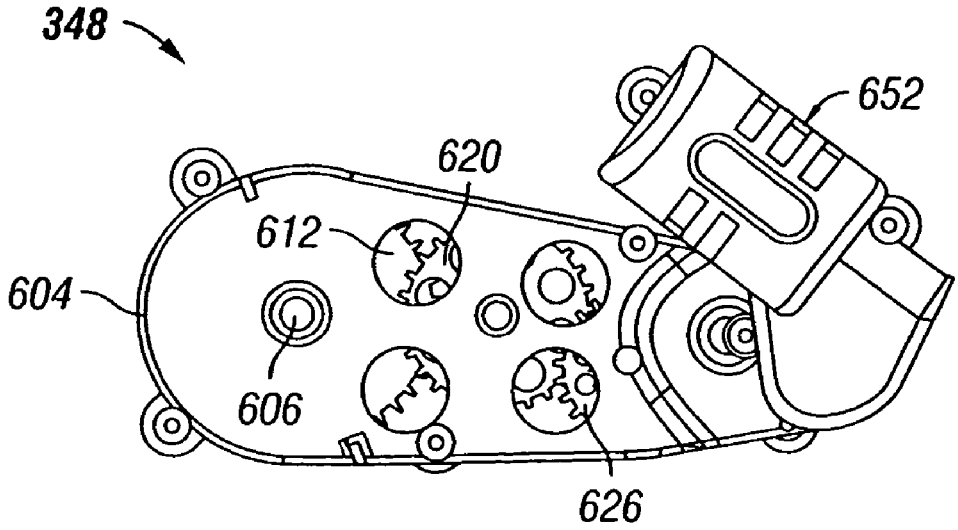
FIG. 32 is a bottom plan view of the torso drive assembly.
Figure 33:
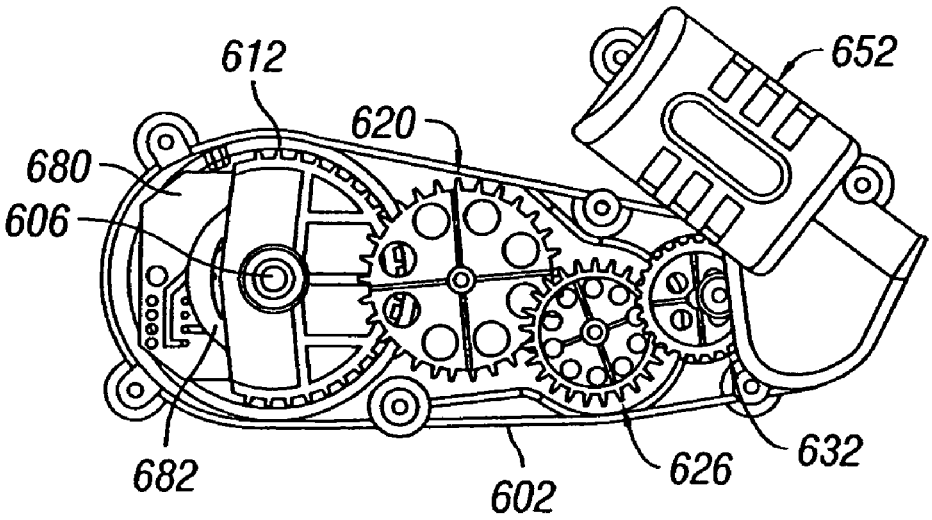
FIG. 33 is a bottom plan view of the torso drive assembly with a lower cover removed to reveal the gear train.
Figure 35:
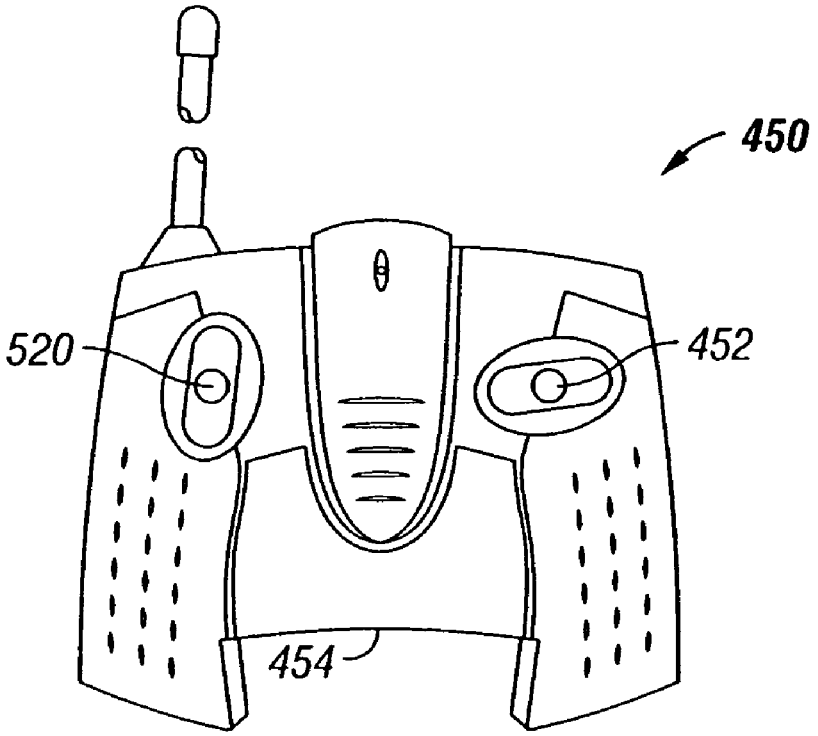
FIG. 35 is a front view of a transmitter for controlling the toy skateboard device.

With further reference to FIGS. 26, 34A and 34B, a torso position feedback board 680 is connected to the upper housing portion 602 and an electrically conductive wiper 682 is mounted on the shaft 606 for rotation therewith. The feedback board 680 preferably includes four arcuate, electrically conductive contact pads 684, 686, 688, and 690 with a center of radius 692 that is coincident with the axial center of the shaft 606. Preferably, the feedback board 680 is a printed circuit board with the contact pads formed thereon through etching, screen printing, or other well-known techniques. The wiper 682 is preferably stamped or otherwise formed of sheet metal and includes three arcuate contact fingers 694, 696, and 698 with a center of radius 700 that is coincident with the axial center of the shaft 606. During rotation of the shaft 606, the contact finger 694 slides in an arcuate path along the conductive pad 684, while the contact fingers 696 and 698 slide in an arcuate path along the conductive pads 686, 688, and 690. The pad 684 may be connected to either ground or a positive voltage, while the pads 686, 688, and 690 are connected to a separate input port of the microcontroller for delivering a logical high or low signal. Alternatively, the pads 686–690 may be multiplexed or serially gated into a single input port for indicating the relative angular position between the shaft 606 and the housing 600, and thus the relative angular position between the lower body portion 312 (FIG. 7) and the upper body portion 314.

In operation, the fingers 696 and 698 will normally be in electrical contact with a center of the pad 688, where the upper torso portion 314 is oriented generally parallel to the lower torso portion 312, and thus a side of the board 306 as shown in FIGS. 7 and 8. In this position, and by way of example, a logical "high" for only the pad 688 is transmitted to a port of the microcontroller, indicating that the upper body portion 314 is "centered." As the relative angle changes between the upper and lower body portions, such as when the upper body portion rotates to the toy figure's far left position as shown in FIG. 9, the fingers 696 and 698 will travel in a counter-clockwise direction as viewed in FIG. 34A. When both fingers 696 and 698 are positioned on the pad 686, a logical "high" associated with only the pad 686 is sent to the appropriate port of the microcontroller, indicating that the upper body portion is rotated to a far left position. Likewise, when the fingers are in contact with only the pad 690, the microcontroller determines that the upper body portion is in a far right position with respect to the lower body portion. Thus, according to a preferred embodiment of the invention, three discrete rotational positions of the upper body portion are detected by the microcontroller. It is to be understood that more or less discrete positions may be provided.

Figure 36:
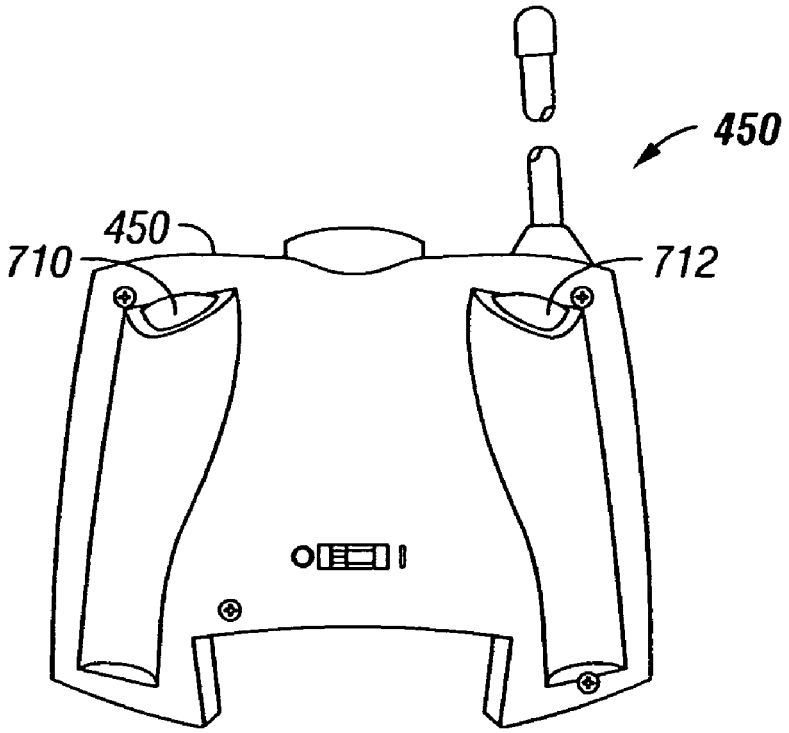
FIG. 36 is a rear view of the transmitter of FIG. 35.

With further reference to FIG. 36, the discrete positions are used in conjunction with control buttons 710 and 712 located on the back of the transmitter 450. The control buttons 710 and 712 are preferably momentary switches that can be pressed by a user to control movement of the upper body portion with respect to the lower body portion. By way of example, when the control button 710 is pressed and held, the upper body portion 314 rotates approximately 90 degrees to the far right position until the button 710 is released, whereupon the upper body portion returns to its centered position. Likewise, pressing and holding the control button 712 causes rotation of the upper body portion 314 approximately 90 degrees to the far left position until released, whereupon the upper body portion returns to its centered position. With the feedback system, the microprocessor can control proper directional rotation of the motor 650 to rotate the upper body portion from its centered position and back again.

Manipulation of the joysticks 452 and 520 in conjunction with the control buttons 710 and 712 causes the skateboard device 300 to perform a variety of different maneuvers and stunts, to thereby simulate the real movement of an actual skateboarder.

It will be understood that the terms upper, lower, side, front, rear, upward, downward, horizontal, and their respective derivatives and equivalent terms, as well as other terms of orientation and/or position as may have been used throughout the specification refer to relative, rather than absolute orientations and/or positions.

It will be appreciated by those skilled in the art that changes could be made to the embodiments described above without departing from the broad inventive concept thereof. For example, it will be appreciated that the truck assembly not directly coupled with a steering mechanism, i.e. the front truck assemblies 18, 91 and 308 can be pivotally connected with the platform 16, 86/88, 306 to also pivot about an axis, e.g. 18' in FIG. 2, 91' in FIG. 4 and 308' in FIG. 13 which is also pitched at an angle between horizontal and vertical, suggestedly mirroring the angle of the pivot axis of each rear truck assembly so that the front truck assemblies will turn in a mirror fashion to the rear truck assemblies to define a radius of turn with the rear truck assemblies. It will be understood, therefore, that this invention is not limited to the particular embodiments disclosed, but it is intended to cover modifications and uses within the spirit and scope of the present invention as defined by the appended claims.

We claim:

1. In a toy including a first member and a second member adjoining the first member, the first and second members being rotatable relative to one another about an axis extending through the first and second members, and a controller at least monitoring relative angular position of the first and second rotary members with respect to one another, a rotary feedback mechanism comprising:

a first set of at least three separate electrically conductive pads non-rotatably mounted to the first member around the axis at least proximal to the second member;

a wiper non-rotatably mounted to the second member abutting the first set of conductive pads so as to sequentially contact at least some of the first plurality of conductive pads with rotation of the first and second members with respect to one another;

a signal commonly provided by the wiper to each of the at least three conductive pads in sequence with rotation of the first and second members with respect to one another;

an individual signal conductor from each of the at least three conductive pads of the first plurality to the controller to provide the controller with one or more of a plurality of the commonly provided signals from each of the separate conductive pads contacted by the wiper, the controller associating each signal of the plurality of signals with an individual electric pad to identify each particular pad being contacted by the wiper at any given time such that relative angular position of the first and second members with respect to one another is determined by the controller from the commonly provided signals fed back to the controller by each particular conductive pad of the plurality.

2. In the toy of claim 1, the rotary feedback mechanism further comprising a separate supply contact on the first member abutting the second member and the wiper and carrying the commonly supplied signal and wherein the wiper includes a plurality of separated, individual fingers electrically connected to one another, at least one finger being located to touch the supply contact on the first member to receive the commonly supplied signal and at least a second finger of the wiper positioned to contact being in sequence, at least some of the first plurality of electrically conductive pads to supply the common signal to each contacted pad.

3. The toy of claim 1 further comprising a steering mechanism having a rotary component, wherein the rotary feedback mechanism is operatively coupled to the rotary component to provide an indication to the controller of an angular position of the rotary component.

* * * * *